US008402784B2

(12) United States Patent
Williams et al.

(10) Patent No.: US 8,402,784 B2
(45) Date of Patent: Mar. 26, 2013

(54) CYLINDRICAL BERNOULLI HEAT PUMPS

(75) Inventors: Arthur R. Williams, Holden, MA (US); Charles Agosta, Harvard, MA (US)

(73) Assignee: MachFlow Energy, Inc., Worcester, MA (US)

( * ) Notice: Subject to any disclaimer, the term of this patent is extended or adjusted under 35 U.S.C. 154(b) by 1017 days.

(21) Appl. No.: 12/403,682

(22) Filed: Mar. 13, 2009

(65) Prior Publication Data

US 2009/0229798 A1 Sep. 17, 2009

Related U.S. Application Data

(60) Provisional application No. 61/069,274, filed on Mar. 13, 2008.

(51) Int. Cl.
*F25D 9/00* (2006.01)

(52) U.S. Cl. ..... 62/401; 62/515

(58) Field of Classification Search ..... 62/86, 87, 62/401, 515; 165/121, 181
See application file for complete search history.

(56) References Cited

U.S. PATENT DOCUMENTS

| | | | | |
|---|---|---|---|---|
| 2,294,350 | A * | 8/1942 | Price | 60/686 |
| 3,200,606 | A * | 8/1965 | Hewett et al. | 62/176.4 |
| 3,305,006 | A * | 2/1967 | Daltry | 165/124 |
| 3,943,728 | A * | 3/1976 | Maudlin | 62/507 |
| 4,787,208 | A * | 11/1988 | DeCorso | 60/723 |
| 4,991,646 | A * | 2/1991 | Spears | 165/122 |
| 6,293,119 | B1 * | 9/2001 | Wenzel | 62/238.6 |
| 6,457,955 | B1 * | 10/2002 | Cheng | 417/423.8 |
| 6,700,237 | B1 * | 3/2004 | Yang | 310/58 |
| 6,702,545 | B2 * | 3/2004 | Scholten | 415/1 |
| 8,152,495 | B2 * | 4/2012 | Boggess et al. | 417/423.14 |
| 2002/0179286 | A1 * | 12/2002 | Sterner | 165/80.3 |
| 2004/0155370 | A1 * | 8/2004 | Kinney et al. | 261/110 |

* cited by examiner

*Primary Examiner* — Mohammad Ali
(74) *Attorney, Agent, or Firm* — Bingham McCutchen LLP

(57) ABSTRACT

Embodiments of a heat transfer apparatus, and related methods, involve a first flow path through at least one neck portion defined by at least one boundary wall, a first heat source external to and in thermal communication with the at least one boundary wall, an inflow portion in fluid communication with the first flow path, an outflow portion in fluid communication with the first flow path, and a drive system for driving a first fluid through the first flow path, whereby heat is transferred from the first heat source to the first fluid as it flows through the first flow path.

5 Claims, 22 Drawing Sheets

CYLINDRICAL BERNOULLI HEAT PUMPS

CROSS-REFERENCE TO RELATED APPLICATIONS

This application claims priority to, and the benefit of, U.S. Provisional Patent Application No. 61/069,274, filed on Mar. 13, 2008, the entire disclosure of which is hereby incorporated by reference.

TECHNICAL FIELD

In various embodiments, the invention relates to heat transfer systems, and more particularly to systems and methods for the transfer of heat between a heat source and a fluid passing a boundary wall in thermal communication with the heat source.

BACKGROUND

Heat transfer systems such as heat pumps may be used to move heat from a source to a sink, and may underlie, for example, the operation of air-conditioning systems and/or heating systems for buildings.

Heat transfer systems can be divided into two fundamental classes distinguished by the direction in which heat moves. In one class of heat transfer system, heat flows from higher temperatures to lower temperatures. This heat flow may, for example, be harnessed to produce mechanical work, as in internal-combustion engines. A second class of heat transfer device includes systems that move heat from lower temperatures to higher temperatures. Such systems are commonly called "heat pumps." Refrigerators and air conditioners, for example, are heat pumps.

Heat pumps necessarily consume power. In general, commonly used heat pumps employ a working fluid (gaseous or liquid) whose temperature is varied over a range extending from below that of the source to above that of the sink to which heat is pumped. The temperature of the working fluid is often varied by compression of the fluid. While conventional heat pumps may be effective in transferring or pumping heat, substantial power (in the form of mechanical work) is necessary to compress the fluid and facilitate heat transfer, making these systems inefficient.

SUMMARY OF THE INVENTION

In various embodiments, the present invention relates to improved systems and methods for transferring heat between a heat source and a fluid. More particularly, embodiments of the invention include heat transfer systems (i.e., systems for moving heat from one location to another), such as, but not limited to heat pumps (i.e., systems that consume power to move heat from one location (a "source") to another, higher temperature location (a "sink" or "heat sink")), that utilize the "Bernoulli principle" to enable heat transfer between a heat source and a working fluid, whereby microscopic random molecular motion (temperature and pressure) is converted into directed motion (macroscopic fluid flow) while leaving the total kinetic energy unchanged. Whereas compression consumes power, Bernoulli conversion does not. Exploitation of the Bernoulli effect, therefore, substantially improves system efficiency relative to conventional, compression-based systems.

In addition, the present invention relates to improved systems and methods for minimizing the creation of entropy during the fluid flow process, thereby further improving the system efficiency relative to conventional, compression-based systems.

One aspect of the invention pertains to a system for transferring heat. Embodiments of the system include a first flow path through at least one neck portion defined by at least one boundary wall, a first heat source external to and in thermal communication with the at least one boundary wall, an inflow portion (where the flow enters the first flow path upstream) in fluid communication with the first flow path, an outflow portion (where the flow exits the first flow path downstream) in fluid communication with the first flow path, and a drive system for driving a first fluid through the first flow path. Heat may be transferred from the first heat source to the first fluid as it flows through the first flow path.

The system may include means defining a return flow path in fluid communication with the inflow portion and the outflow portion to produce a closed loop flow. The system may further include a heat exchanger along the return flow path, e.g., to remove heat from a fluid flowing through the return flow path. The inflow portion and/or the outflow portion may be in fluid communication with the surrounding atmosphere.

The drive system may include at least one first radial array of blades positioned within the neck portion, at least one second radial array of blades axially displaced from the neck portion, and a gear box linking the first radial array of blades to the second radial array of blades. Rotation of the first radial array of blades provides a driving force for the second radial array of blades.

The drive system may include a radial array of blades arranged about a central portion defining an entrance flow path; adjacent blades define the first flow path therebetween. The inflow portion may be in fluid connection with the central portion of the radial array of blades, and the outflow portion may be located radially outside the plurality of blades. In various embodiments, the drive system forces the first fluid into the central portion and out through the first flow path between each adjacent blade.

Another aspect of the invention pertains to a heat transfer apparatus, embodiments of which include a plate having first and second opposed walls with an open central portion therethrough. The open central portion (for example, an axially extending open portion through the central portion of the plate) is defined by a perimeter wall extending between the first and second opposed walls. A first flow path extends through the open central portion. A plurality of blades adjacent to the second plate wall are arranged about the open central portion; adjacent blades define a second flow path between the blades. The apparatus also includes a first heat source in thermal communication with the perimeter wall, and a drive system for driving a first fluid through the first flow path and out through the second flow path between adjacent blades, whereby heat is transferred from the first heat source to the first fluid flowing within the first flow path.

In one embodiment, the apparatus includes means defining an axially extending outer flow path located radially outside the plurality of blades. The apparatus may further include means defining a radially converging flow path from the axially extending outer flow path to the first flow path. The first flow path, second flow path, axially extending outer flow path, and radially converging flow path may define a closed loop. The second flow path, axially extending outer flow path, and radially converging flow path may define a return flow path. In various embodiments, the apparatus includes a heat exchanger located along at least a portion of the return flow path for removing heat from a fluid flowing through the return path. The first heat source may include a heat-source fluid flow path extending through at least one channel in at least a portion of the plate.

The first flow path may have or include a neck portion. In an exemplary implementation, the apparatus includes a fluid drive system for driving the heat-source fluid flow. At least a portion of the perimeter wall may exhibit a high thermal conductivity.

The plurality of blades may be configured for rotation about the open central portion. The blades may rotate at a sufficient rotation rate to extend at least a portion of the mean flow direction of the second flow path to point at least partially towards the receding or advancing surfaces of the blades. The plurality of blades may alternatively rotate at a sufficient rotation rate to extend the mean flow direction of the second flow path substantially parallel to the walls of two adjacent blades. The plurality of blades may be configured such that substantially no portion of the mean flow direction of the second flow path extends towards an advancing or receding wall of a blade.

Another aspect of the invention pertains to a method of transferring heat. Embodiments of the method include providing a plate having first and second opposed walls with an open central portion therethrough. The open central portion is defined by a perimeter wall extending between the first and second opposed walls. A first flow path extends through the open central portion, and a plurality of blades adjacent to the second plate wall are arranged about the open central portion; adjacent blades define a second flow path therebetween. A first heat source is in thermal communication with the perimeter wall, and a first fluid is driven through the first flow path and out through the second flow path between adjacent blades. Heat may thereby be transferred from the first heat source to the first fluid flowing within the first flow path.

In one embodiment, the method further includes transporting a fluid from an exit portion of the first flow path to an entrance portion of the first flow path through means defining a return flow path. The method may include providing means defining an axially extending outer flow path located radially outside the plurality of blades and, in an embodiment, a radially converging flow path from the axially extending outer flow path to the first flow path. The first flow path, second flow path, axially extending outer flow path, and radially converging flow path may define a closed loop. In various embodiments, the further includes removing heat from a fluid flowing through the return path. The heat may be removed, for example, by a heat exchanger in thermal communication with at least a portion of the return flow path. The first heat source may include a heat-source fluid flow path extending through at least one channel in at least a portion of the plate. In some embodiments, the method includes driving the heat-source fluid flow with a fluid drive system. In an exemplary implementation, at least a portion of the perimeter wall exhibits a high thermal conductivity. The first flow path may include a neck portion.

In various embodiments, the method includes rotating the plurality of blades about the open central portion. This may occur at a sufficient rotation rate such that at least a portion of a mean flow direction of the second flow path extends at least partially towards the receding or advancing surfaces of the blades. Alternatively, the mean flow direction of the second flow path may extend substantially parallel to a wall of two adjacent blades. The plurality of blades may be configured (e.g., shaped, sized, and/or oriented) such that substantially no portion of the mean flow direction of the second flow path extends towards an advancing or receding wall of a blade.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

In general, the present invention relates to heat transfer systems, and more particularly to Bernoulli heat pumps for use in transferring heat from a heat source to a working fluid.

Figure 1A:
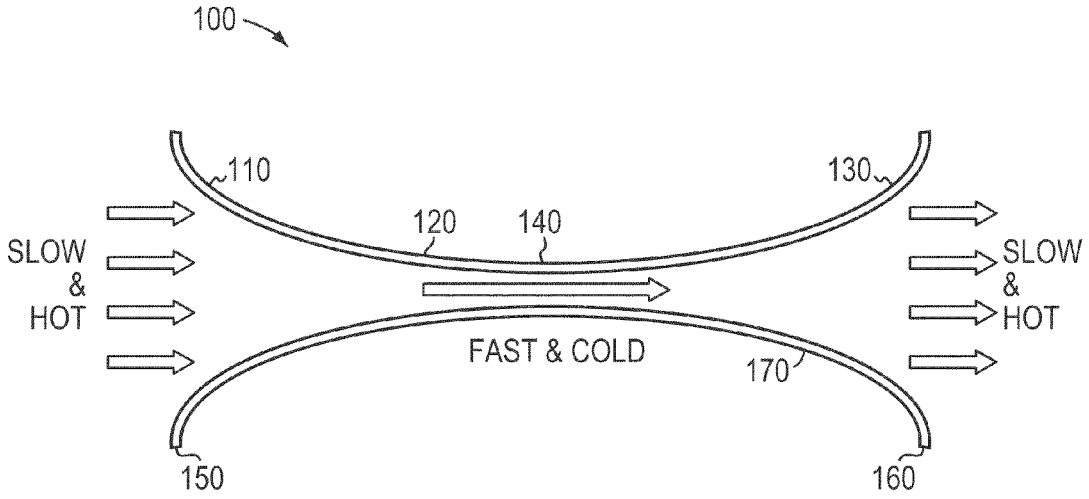
FIG. 1A shows a schematic side view of a venturi shaped flow, in accordance with one embodiment of the invention.
Figure 1B:
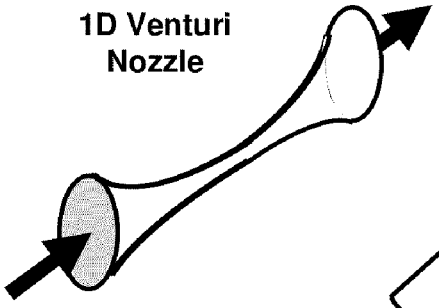
FIG. 1B shows a schematic perspective view of a cylindrical venturi nozzle, in accordance with one embodiment of the invention.
Figure 1C:
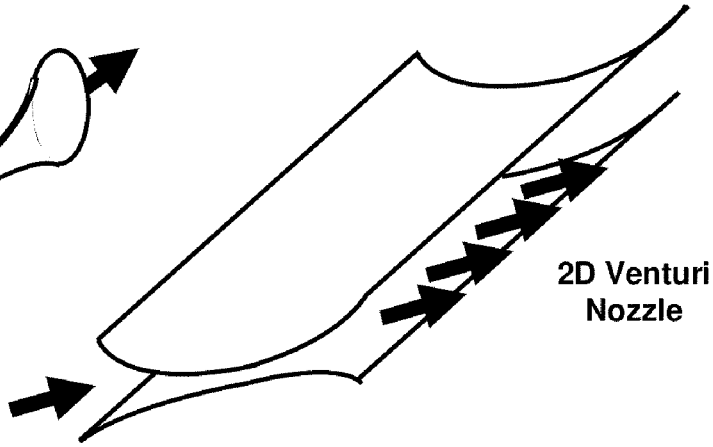
FIG. 1C shows a schematic perspective view of a two-dimensional venturi nozzle, in accordance with one embodiment of the invention.

One embodiment of the invention includes a venturi-shaped channel through which a working fluid can flow in accordance with the Bernoulli principle. An exemplary venturi 100 is shown in FIG. 1A. The venturi 100 includes an inlet portion 110, a neck portion 120 (e.g., a region of the flow-path with a heat exchanging boundary, 120 and/or 140, connecting the region of decreasing cross-sectional area to the region of increasing cross-sectional area), and a diffuser or outlet portion 130, with the cross-sectional area of the venturi 100 decreasing from the inlet portion 110 to the neck portion 120 and increasing, after passing an apex 140 of the neck portion 120, in the outlet portion 130. The venturi 100 may have any appropriate cross-sectional shape such as, but is not limited to, a circular, oval, square, or rectangular cross-section. The cross-sectional shape may be constant along the length of the venturi 100. Alternatively, depending on the application, the cross-sectional shape may vary along the length of the venturi 100. For example, the cross-section of the venturi 100 may be substantially circular at an apex 140 of the neck portion 120 while being substantially square at an outer edge 150 of the inlet portion 110 and/or an outer edge 160 of the outlet portion 130. An example venturi nozzle 100 with a cylindrical cross-section (e.g. a venturi nozzle with a cross-sectional area varying along a length thereof) is shown in FIG. 1B, while an example venturi nozzle 100 with a rectangular cross-section (e.g. a venturi nozzle with a cross-sectional area varying along a length thereof due to a variation of only one dimension of the cross-section) is shown in FIG. 1C.

In operation, a working fluid enters the venturi 100 through the inlet portion 110. As the cross-sectional area of the venturi 100 decreases towards the neck portion 120, the directed motion of particles within the working fluid must increase in order to maintain a constant mass flux. Such conversion occurs, without the addition of energy, by the local reduction of the random molecular motion of the particles. As a result, as the cross-sectional area decreases, the temperature and pressure of the working fluid decrease, while the velocity of the working fluid increases. Whereas compression consumes power, Bernoulli conversion does not. Though Bernoulli conversion itself consumes no power, the fluid nozzling may result in relatively strong velocity gradients within the working-fluid flow, which may result in some viscous loss. After passing through the neck portion 120, the cross-sectional area of the venturi 100 increases, resulting in a reduction in fluid velocity and a corresponding increase in pressure and temperature.

Therefore, as the working-fluid flows through the central neck portion 120 of the venturi 100, the velocity of the fluid increases while the temperature decreases. After the working fluid has substantially passed the apex 140 of the central neck portion 120, the velocity of the working fluid decreases while the temperature increases. As a result, a venturi 100 may be used to quickly and efficiently reduce the temperature of a working fluid in the vicinity of the neck portion 120. Placing a heat source at or near the neck portion 120 allows the venturi 100 to act as a heat transfer system, with heat being passed from the heat source to the working fluid at the neck portion 120 as long as the temperature of the working fluid at the neck portion 120 is lower than that of the heat source (regardless of whether the temperature of the working fluid entering the inlet portion 110 is higher than that of the heat source). In various embodiments, the heat source is located within the neck portion 120, in the outlet portion 130 downstream of the neck portion 120, or extending between both the neck portion 120 and the outlet portion 130.

In one embodiment, the venturi 100 is operated by driving the working fluid through a flow path defined by at least one boundary wall 170. The boundary wall 170 may be formed from any appropriate material including, but not limited to, a metal, a ceramic, a plastic, or a composite material. In an alternative embodiment, the flow path including the venturi 100 may be self-forming, for example, by directing gas through a small aperture.

Figure 2:
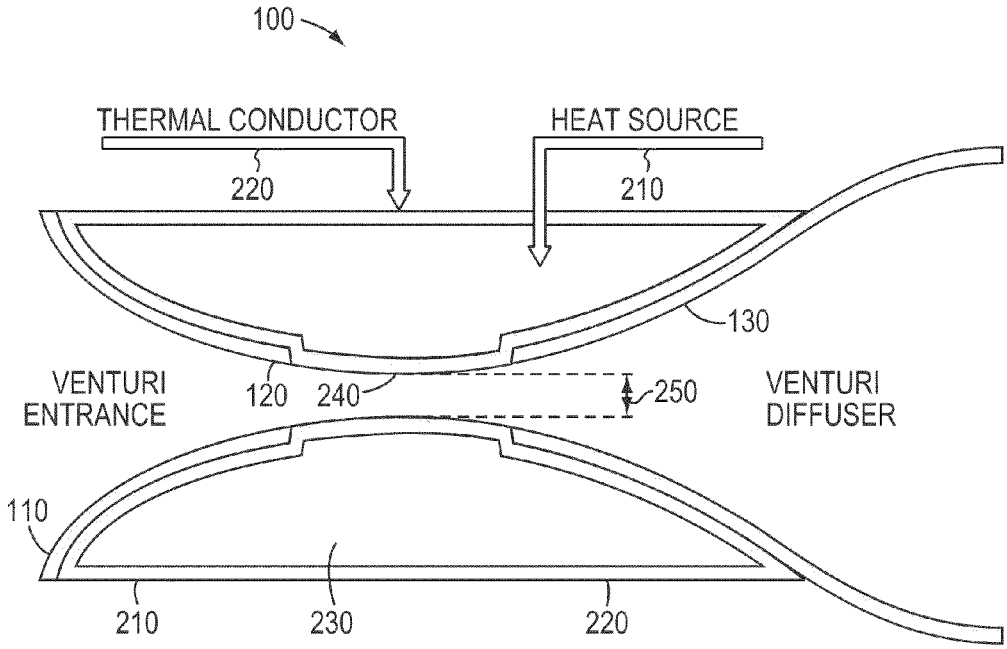
FIG. 2 shows a schematic side view of a heat transfer system including a venturi flow, in accordance with one embodiment of the invention.

An exemplary venturi 100 including a heat source in thermal communication with a neck portion 120 of the venturi 100 is shown in FIG. 2. In this embodiment, a working fluid is driven from an inlet portion 100, through the neck portion 120, and out through an outlet portion 130. A heat source 210 is positioned within the neck portion 120. The heat source 210 may be a source of air to be cooled, such as an interior air flow in a building, for an air conditioning system. Alternatively, the heat source may include a recirculating cooling fluid for a mechanical device, a pipe flow in a fluid transport system (such as, for example, an oil or gas piping system), a mixed-phase fluid flow, or any other appropriate fluid flow or solid heated material requiring cooling. Example heat sources may include components for electrical systems and/or vehicles, such as aircraft or ground transportation.

In the illustrated embodiment, the heat source 210 includes a channel 220 through which a heated fluid 230 is flowed. The channel 220 may include a material selected to provide a high thermal conductivity between the heat source 210 and the working fluid within the venturi 100. A high thermal conductivity material may include any material having a thermal conductivity that is higher than that of one or more surrounding materials in thermal communication with the high thermal conductivity material. Example materials include, but are not limited to, metals (such as, but not limited to, copper or aluminum), graphite-based materials, textured surfaces, including nano-textured surfaces, and/or carbon nano-tube based materials. In one embodiment, the channel 220 may include or consist essentially of a material such as, but not limited to, a metal such as copper, steel, aluminum, a ceramic, a composite material, or combinations thereof.

The channel 220 may be constructed from a single material or from a plurality of materials. For example, one embodiment of the invention includes a channel 220 having a high thermal conductivity in contact with the neck portion 120 of the venturi 100; elsewhere, the flow path has a lower thermal conductivity, or even a high thermal insulation.

In an alternative embodiment, the heat source 210 is a solid block of material, without a channel defined therethrough, such as, but not limited to, a metal such as copper, steel, aluminum, a ceramic, a composite material, or combinations thereof. The material is selected to provide a high thermal conductivity between the heat source 210 and the working fluid within the venturi 100. The solid block heat source 210 relies on conduction through the material to transport heat from a source to the neck portion 120 of the venturi 100.

In one embodiment, a portion 240 of the channel 220 is embedded within the boundary wall 170 of the venturi 100, such that the channel is in direct physical contact with the working fluid within a portion of the venturi 100, e.g., within the neck portion 120. In an alternative embodiment, the heat source 210 is placed against a sealed boundary wall 170 of the venturi 100, such that any heat transferred between the heat source 220 and the working fluid must pass through the boundary wall 170.

The heat source 210 may have any appropriate cross-sectional shape. For example, as shown in FIG. 2, the heat source 210 may conform to the boundary wall 170 of the venturi 100 along a portion thereof. Alternatively, the heat source 210 may have any desired cross-sectional shape such as, for example, a circular, oval, square, or rectangular cross-section.

In operation, heat is transferred from the heat source 210 to the working fluid as it passes through the neck portion 120 of the venturi 100 (i.e., the portion of the venturi 100 where the velocity is at or near a maximum and the temperature is at or near a minimum). Because convection is orders of magnitude more effective than conduction in transferring heat, the surface area of the channel portion 240 exposed to the working-fluid flow can be much smaller than that exposed to the heat-source flow. As a result, the entire channel 220 may be formed from a material exhibiting a high thermal conductivity (e.g., a metal), thereby allowing heat to be conducted from the heat-source fluid 230 to the channel 220 over the entire cross-section of the channel 220, after which the heat is transferred from the channel 220 to the working fluid within the venturi 100 through the exposed channel portion 240.

Figure 3:
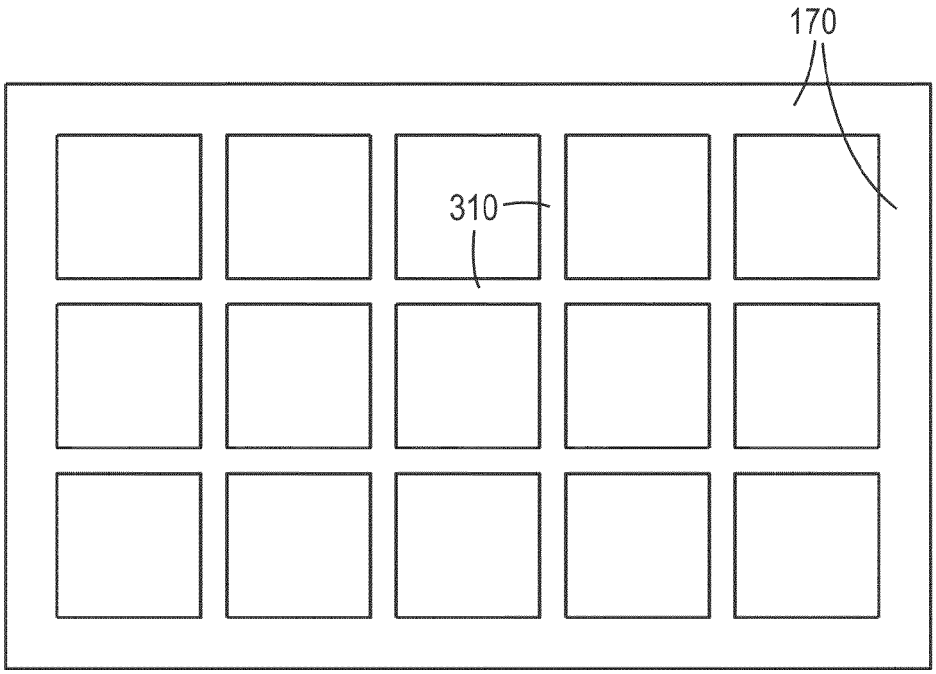
FIG. 3 shows a schematic front view of a grid structure for a heat transfer system including a venturi flow, in accordance with one embodiment of the invention.

One or more fins may extend from the channel portion 240 into either the working fluid within the venturi 100 and/or into the heat-source fluid 230 to provide additional surface area over which heat transfer can take place. These fins may have any appropriate size and shape, and may be formed from any of the thermally conducting materials described herein. An exemplary fin structure for placement within the neck portion 120 of a venturi 100 is shown in FIG. 3. In this embodiment, fins 310 extend from the boundary wall 170 of the venturi 100 and are arranged in a grid pattern. The fins may, for example, be formed from the same material as the heat source channel 220 (in the case of a fluid flow based heat source) or of the same material as the heat source 210 itself (for a solid heat source). In one embodiment, the fins 310 extend from the exposed channel portion 240 at an apex 140 of the venturi 100. In alternative embodiments, any appropriate number, arrangement and placement of fins may be used. The fins may be hollow to allow the heated fluid to be cooled 230 within the heat source channel 220 to flow through the fins.

The height 250 of the apex 140 of the neck portion 120 may be substantially smaller than the width of the cross-section at the apex 140, thereby allowing heat to be transferred between the heat source 210 and the working fluid within the venturi 100 over a substantial area.

In one embodiment, the venturi 100 is constructed as an open-loop system, such that the working fluid is entrained from the surrounding atmosphere and exhausted to the surrounding atmosphere after being driven through the venturi 100. In this embodiment, the working fluid may include, or consist essentially of, air, one or more high-gamma (heat capacity ratio) and/or low-$c_p$ (specific heat at a constant pressure) gases, one or more rare gases, particles of one or more solid materials, or mixtures thereof. A high-gamma gas is one having a value of gamma greater than that of air, while a low-$c_p$ gas is one having a value of $c_p$ lower than that of air. In another embodiment (for example, an implementation designed for underwater heat transfer), the working fluid may include, or consist essentially of, water, one or more high-gamma and/or low-Cp gases, one or more rare gases, particles of one or more solid materials, or mixtures thereof. But more generally, any suitable gaseous or liquid working fluid may be utilized. The suitability of a working fluid may be determined by factors including, but not limited to, the thermal properties of the material, viscosity, toxicity, expense, and/or scarcity. In one embodiment, working fluids having lower values for specific heat are advantageous, at least because the specific heat determines how big a temperature drop is produced by a given flow speed. Suitable fluids include, but are not limited to, those having high thermal conductivity, low viscosity, appropriate gas-liquid transition temperatures, low cost (e.g. to manufacture and handle), and/or meeting required environmental standards. The working fluid may be driven through the venturi 100 by a fan, pump, blower, or other appropriate fluid drive system, placed either upstream of the venturi 100 (i.e. before the inlet portion 110) or downstream of the venturi 100 (i.e. after the outlet portion 130).

In an alternative embodiment, the venturi 100 is part of a closed-loop system wherein, upon exiting the outlet portion 130 of the venturi 100, the working fluid is recirculated back to the inlet portion 110. As the working fluid in a closed-loop system is not exhausted to the surrounding atmosphere, fluids which may be environmentally damaging, but which provide improved heat transfer characteristics over air, may be utilized. In order to remove the heat transferred to the working fluid from the heat source 210, one or more heat exchangers may be incorporated into a return leg of a closed-loop system.

Figure 4A:
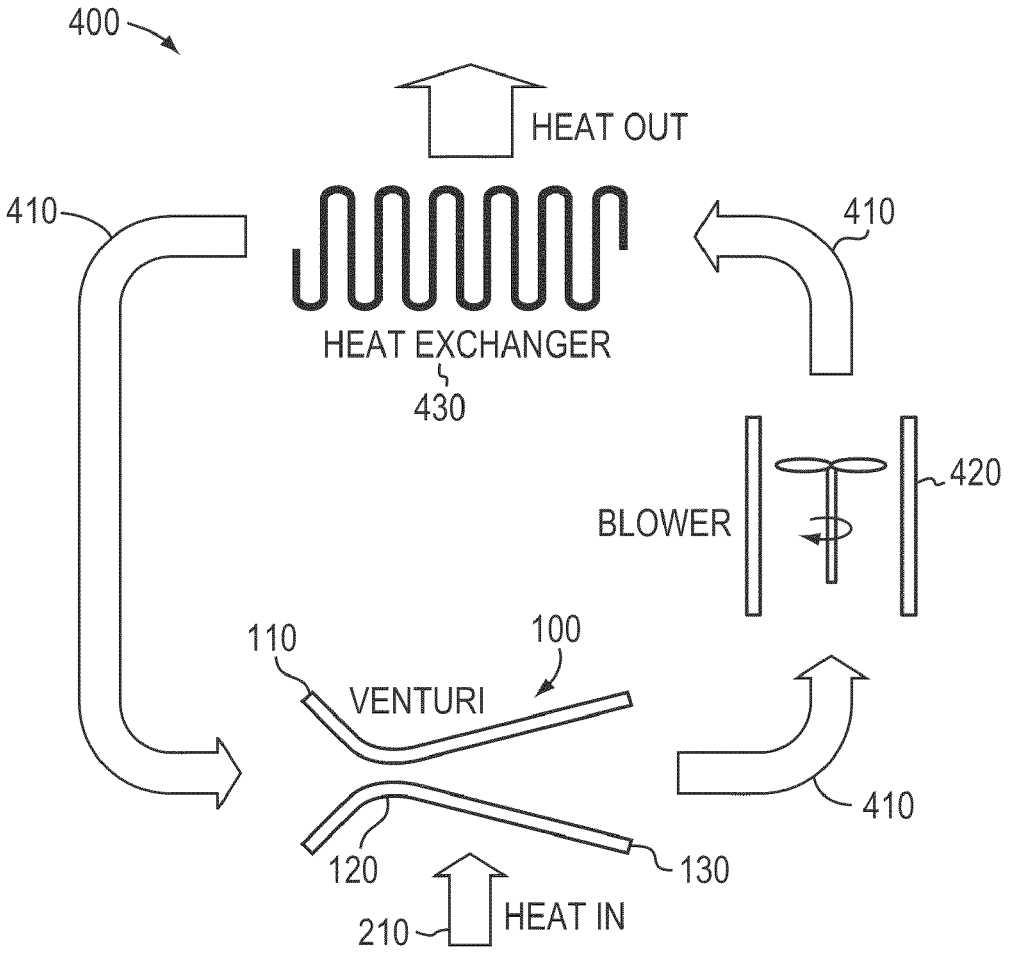
FIG. 4A shows a schematic view of a closed-loop heat transfer system including a venturi flow, in accordance with one embodiment of the invention.

FIG. 4A illustrates an exemplary closed-loop heat transfer system incorporating a return leg including a heat exchanger. In this embodiment, the heat transfer system 400 includes a venturi 100 through which a working fluid is driven, as described above. A heat source 210 is placed in thermal contact with the neck portion 120 of the venturi 100; heat is transferred from the heat source 210 to the working fluid as it is driven through the venturi 100. Upon exiting the outlet portion 130 of the venturi 100, a fluid return path 410 carries the working fluid back to the inlet portion 100 of the venturi 100. This fluid return path 310 may include, for example, a closed duct system through which the fluid is free to travel. One or more means of driving the working fluid around the fluid return path 410 and through the venturi 100 may be placed at any appropriate location within the system 400. For example, the embodiment shown in FIG. 4A includes a blower fan 420 located downstream of the venturi 100. More generally, any suitable fluid driving system may be used including, but not limited to, blowers, fans, pumps, turbines, and/or jets. Indeed, multiple fluid driving means—e.g., a plurality of blower fans 420 positioned at various locations around the closed fluid return flow path 410—may be used.

One or more heat exchangers 430 may be placed along the fluid return path 410 to remove the heat transferred to the working fluid from the heat source 210. The form of heat exchanger 430 is not critical to the present invention. Suitable configurations include, but are not limited to, parallel-flow heat exchangers, cross-flow heat exchangers, counter-flow heat exchangers, shell and tube heat exchangers, plate heat exchangers, regenerative heat exchangers, adiabatic wheel heat exchangers, plate fin heat exchangers, multi-phase heat exchangers, spiral heat exchangers, or combinations thereof. This heat exchanger 430 may, for example, take heat from the working fluid and vent it to the surrounding atmosphere.

The heat transfer system 430 may be used, for example, in an air-conditioning system, where heat is to be removed from the interior of a building and vented to the exterior of the building. In this embodiment, the heat source may include a flow of interior building air which is driven passed one or more venturis 100. Heat from the interior air is transferred to the working fluid, after which the interior air is exhausted back into the building. The heat that is transferred to the working fluid can then be removed from the working fluid by the heat exchanger 430, which vents the heat to the atmosphere outside the building. Alternatively, the heat from the working fluid may be utilized for other purposes, e.g., local or special-purpose heating, or power generation.

In alternative embodiments, heat transfer systems according to the invention include a plurality of venturis 100, heat sources 210, heat exchangers 430, and/or flow paths 410. Heat transfer systems according to the invention may also include both open-loop flow paths and closed-loop flow paths for either the working fluid and/or a heat-source fluid flow.

In one embodiment, additional (and conventional) control devices are incorporated into the system to control elements of the working-fluid flow including, but not limited to, the velocity, the pressure, the temperature, the humidity, and the volume and/or proportions of individual components of the working fluid. Measurement devices may also be incorporated into the system to monitor performance characteristics of the system including, but not limited to, the temperature, velocity, pressure, and properties and/or proportions of the individual components of the working fluid. In one embodiment, a control system receives data from the measurement device(s) and utilizes these to operate the control devices in order to optimize the performance of the system, continuously and in real-time. The control system may also respond to user inputs.

Figure 4B:
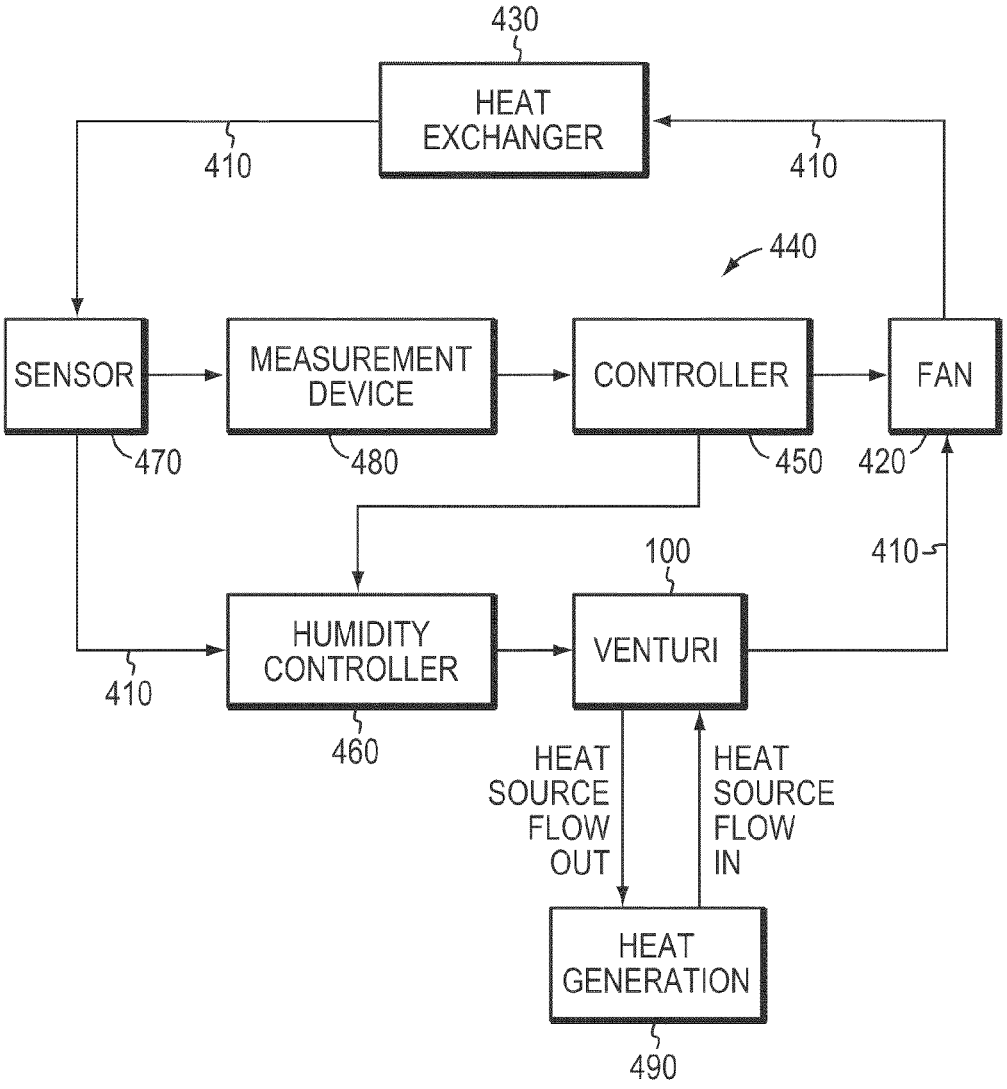
FIG. 4B shows a schematic view of the closed-loop heat transfer system of FIG. 4A, further including a control system.

An exemplary heat transfer system 400 including a control system 440 is shown in FIG. 4B. The control system 440 includes a controller 450 (e.g., an electronic controller such as a computer, and/or a mechanical controller) that controls the functionality of a humidity controller 460 and/or a fan 420. The humidity controller 460, or other appropriate flow-control element, controls the injection of a second fluid component into the working-fluid flow. In one embodiment, no humidity controller is required. The control system 440 also includes at least one sensor 470 for sensing at least one parameter of the working-fluid flow (such as, but not limited to, temperature, flow rate, pressure, density, humidity, and/or chemical composition). The sensor(s) 470 may be place at any appropriate location within the heat transfer system 400 such as in the return flow path 410 upstream of the venturi 100. The sensor 470 is coupled to a measurement device 480 which communicates with the sensor 470 and sends a measured reading from the sensor 470 to the controller 450. In an alternative embodiment, the sensor 470 may communicate directly with the controller 450, without the need for a measurement device 480 therebetween. In operation, the control system 440 controls at least one parameter of the working-fluid flow to assist in controlling the transfer of heat between the working fluid and the heat-source flow (from a heat-generation source 490 such as, for example, the interior air flow of a building).

In one embodiment, a pressure-control system may be used in a closed-loop system to control the pressure of the working fluid within the system. For example, a pressure-control system may pressurize the working fluid within the system to either above or below atmospheric pressure. In one embodiment, the working fluid is pressurized to a pressure of between 1.2 and 1.8 atmospheres, and more typically to a pressure of between 1.4 and 1.6 atmospheres. In an exemplary embodiment, the working fluid is pressurized to a pressure of approximately 1.5 atmospheres. In one embodiment, a heat transfer system includes a plurality of venturis 100, which may, for example, be stacked together to form the heat transfer system. This system may be used, for example in an automobile radiator.

The efficiency of a Bernoulli heat pump is, in general, limited by factors such as the entropy increase associated with the exhaust of heat at a temperature above that at which the heat was acquired and/or the entropy increase due to the variation of the flow speed across the boundary layer at the venturi wall (which, in turn, is related to the viscosity multiplied by the square of the velocity gradient).

More particularly, due to the effects of viscosity, Bernoulli conversion is not fully reversible. That is, that after passing through the neck of the venturi, the flow does not simply return to the same flow conditions that it had upstream of the neck portion. Rather, the fluid dynamics of flow upstream and downstream of the neck of the venturi are quite different, especially with regard to the sign of the pressure gradient and the stability of the flow with respect to turbulence.

If the flow remains laminar downstream of the neck, then its cross-sectional area does not spontaneously increase. The result is called a "laminar jet." The "unfavorable" sign (>0) of the longitudinal pressure gradient downstream of the neck renders laminar flow unstable. If any condition (e.g., surface roughness) triggers the transition, the flow becomes turbulent, and its cross-sectional area increases. While the dramatic increase in effective viscosity that accompanies the transition to turbulent flow increases the cross-sectional area of the flow, it also increases the irreversible dissipation. For example, experimental data for so-called "critical flow venturis" (CFVs) suggests that the pressure recovery for Mach-1 venturis is limited to approximately 90%. That is, a pressure drop of 10% across the venturi is required to maintain the flow, even if the venturi surface is very smooth. The power consumed maintaining the flow is proportional to this pressure drop; the coefficient of proportionality is the volume flow rate.

Bernoulli heat pumps may be either open-loop or closed-loop. In general, both open and closed systems require a venturi and a source of shaft work to maintain flow through the venturi. The shaft work may be provided, for example, by an axial blower. Open and closed systems differ in the disposition of the heat transferred to the working fluid in the venturi neck. In open systems, the working fluid emerging from the venturi and the heat that has been transferred to it are simply exhausted into the environment. In closed systems, the working fluid is not discharged, but rather is returned to the entrance of the venturi for repeated use. While closed systems offer greater choice with regard to the fluids used, they may require removal of the heat transferred to the working fluid (e.g., by a heat exchanger), as discussed, for example, with respect to FIGS. 4A and 4B. The heat transferred into and out of the working fluid by the heat source and sink are commonly delivered by independent fluid flows. Similarly, the source and sink fluid flows are maintained by fluid drive devices such as, but not limited to, pumps, blowers or fans. These propulsion devices, whatever their character, generally require power consuming motors. The heat delivered by the heat source need not be carried by a fluid flow, but can, in certain embodiments, be delivered directly through a thermal conductor exposed directly to whatever is to be cooled.

In addition, due to the effects of viscosity, the working-fluid flowing through a venturi will include boundary-layer regions extending from the boundary walls of the venturi. More particularly, thermal equilibrium at the boundary wall implies the so-called "no-slip" boundary condition, wherein the mean velocity of the working fluid at the surface of the boundary wall is zero. The no-slip condition, in turn, implies a sharp variation of the macroscopic flow speed across (i.e., transverse to) the flow. The thin region in which this sharp variation occurs is called the boundary layer. Sharp speed variation causes the viscous generation of heat. The interplay among the viscous generation of heat, the conduction of heat by the slowly moving fluid near the boundary wall, and the convection of heat by the rapid axial flow away from the venturi wall determines the variation of the fluid temperature across the boundary layer.

This interplay may limit the transfer of heat into the working-fluid flow. The flow of heat between the boundary wall and the working-fluid flow is affected by the transverse temperature gradient at the venturi wall. In particular, viscous heating causes the sign of this gradient to change as the wall temperature is varied. As the wall temperature is reduced, a temperature is reached for which the transverse temperature gradient vanishes. Further reduction of the wall temperature results in heat transfer from the working fluid into the venturi wall. The temperature at which the transverse temperature gradient changes sign is called the adiabatic or recovery temperature. Temperature recovery across the boundary layer may, in some embodiments, limit the effectiveness of cooling based on the Bernoulli effect.

Figure 5:
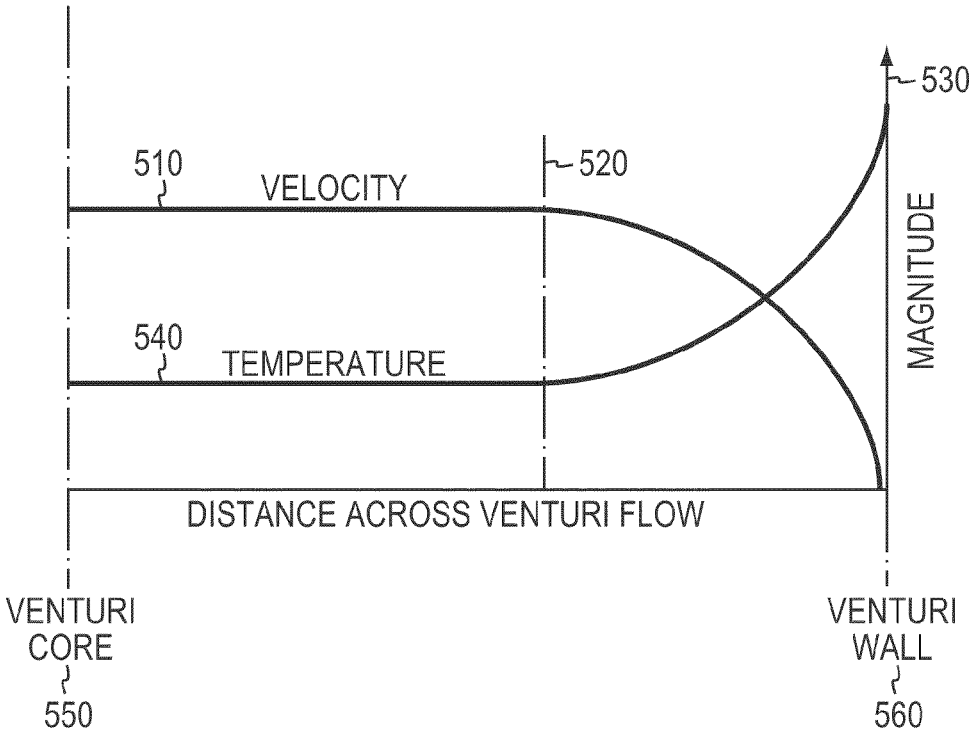
FIG. 5 is a graph showing the relationship between velocity and temperature across a width of a neck portion of a heat transfer system including a venturi flow, in accordance with one embodiment of the invention.

The relative change in velocity and temperature of the working fluid near the boundary wall of a venturi is shown graphically in FIG. 5. More particularly, FIG. 5 shows the magnitude 530 of the velocity 510 of the working fluid decreasing from its free-stream value (in the venturi core 550 above the edge of the boundary layer 520) down to zero at the boundary wall 560 of the venturi. Simultaneously, the graph shows the temperature 540 of the working fluid increasing as it approaches the boundary wall 560 of the venturi.

In various embodiments of the invention, the working fluid may consist essentially of a single fluid component. This fluid component may be a gas such as, for example, air, oxygen, a high-gamma gas, a rare gas, and/or mixtures thereof. In one embodiment the fluid component is a liquid, such as, for example, water. Alternatively, the working fluid may include a plurality of fluid components. In such cases, a heat transfer system incorporating a venturi can achieve a greater level of heat transfer than may be achieved using a single, unitary working fluid. In one embodiment, the working fluid includes two separate fluid components. In an alternative embodiment, three or more fluid components are used. By using a working fluid including a plurality of fluid components, the effect of the boundary layer on the transfer of heat from the heat source (in thermal communication with the boundary layer) to the working fluid may be substantially reduced. For example, in one embodiment of the invention, the working fluid includes air as the first fluid component. A second fluid component such as water is entrained into the fluid flow. Upon passing through the neck portion of a venturi, the second fluid component is separated from the mean flow path of the working fluid, passing through the boundary layer in the fluid near the wall, and striking the surface of the boundary wall. When lower-temperature particles of the second fluid component impinge against the boundary wall, heat transfer therebetween increases.

The first and second working fluid components may be segregated within the venturi by any suitable means. More particularly, to achieve increased heat transfer, particles of a second fluid component—whatever their composition or thermodynamic state—after coming into thermal equilibrium with the working-fluid flow in the free-stream portion of the flow, are segregated from the first fluid component and impinge upon a boundary wall of the venturi. Segregating the first and second fluid may be accomplished by, for example, filtering, dehumidification and/or exhaust scrubbing.

Embodiments of the invention may include systems and/or methods to increase the efficiency of a heat transfer system by using kinetic energy generated within a high-flow-rate portion of the system to power a drive system for the working fluid. For example, in one embodiment, kinetic energy in the working fluid through the neck portion of the venturi is removed from the flow by a first radial array of blades, and transferred to a second radial array of blades (e.g. a blower) which is used to drive the working-fluid flow. This may compensate, at least in part, for any viscous losses generated within the venturi. The first radial array of blades may be positioned at or near an apex of the venturi, or may instead be placed at another location within or near the neck portion of the venturi. The second radial array of blades may be axially displaced from the neck portion, and may, for example, be placed either upstream or downstream of the neck portion. For example, the second radial array of blades may be placed either in an inlet and/or outlet portion of the venturi. Alternatively, the second radial array of blades may be placed at any point in the return flow path of a closed loop system. In one embodiment, the energy generated by the first radial array of blades is used to drive a single second radial array of blades. In alternative embodiments, the energy generated by the first radial array of blades is used to at least partially power multiple second radial arrays of blades.

One or more first radial arrays of blades may be coupled to one or more second radial arrays of blades through a mechanical or electrical coupling system. For example, the first radial array(s) may be mechanically connected to the second radial array(s) through one or more mechanical linkages. The mechanical linkage may include a gear box to account for the difference in flow speed between the first radial array of blades (operating within the fast-flowing working fluid in the neck portion) and the slow-moving working fluid away from the neck portion. The first radial array(s) may also be coupled to the second radial array(s) through an electrical coupling system, with the energy captured by the first radial array(s) being converted into electrical energy which can then be sent to the second radial array(s), located at any position within the system, to drive the working fluid.

In operation, as a working fluid passes through the neck portion of a venturi, the velocity of the working fluid increases. Placing the first radial array(s) within the neck portion means that it is driven by the accelerated working fluid. The energy captured by the first radial array(s) as it is (or they are) driven by the working fluid may then be used to drive the second radial array(s) located elsewhere in the system and, for example, either upstream or downstream of the neck portion. This second radial array(s) may then drive the working fluid through the neck portion. As a result, kinetic energy within the neck portion can be harnessed to assist in driving the working fluid, thereby reducing the amount of energy required to drive the system.

Figure 6A:
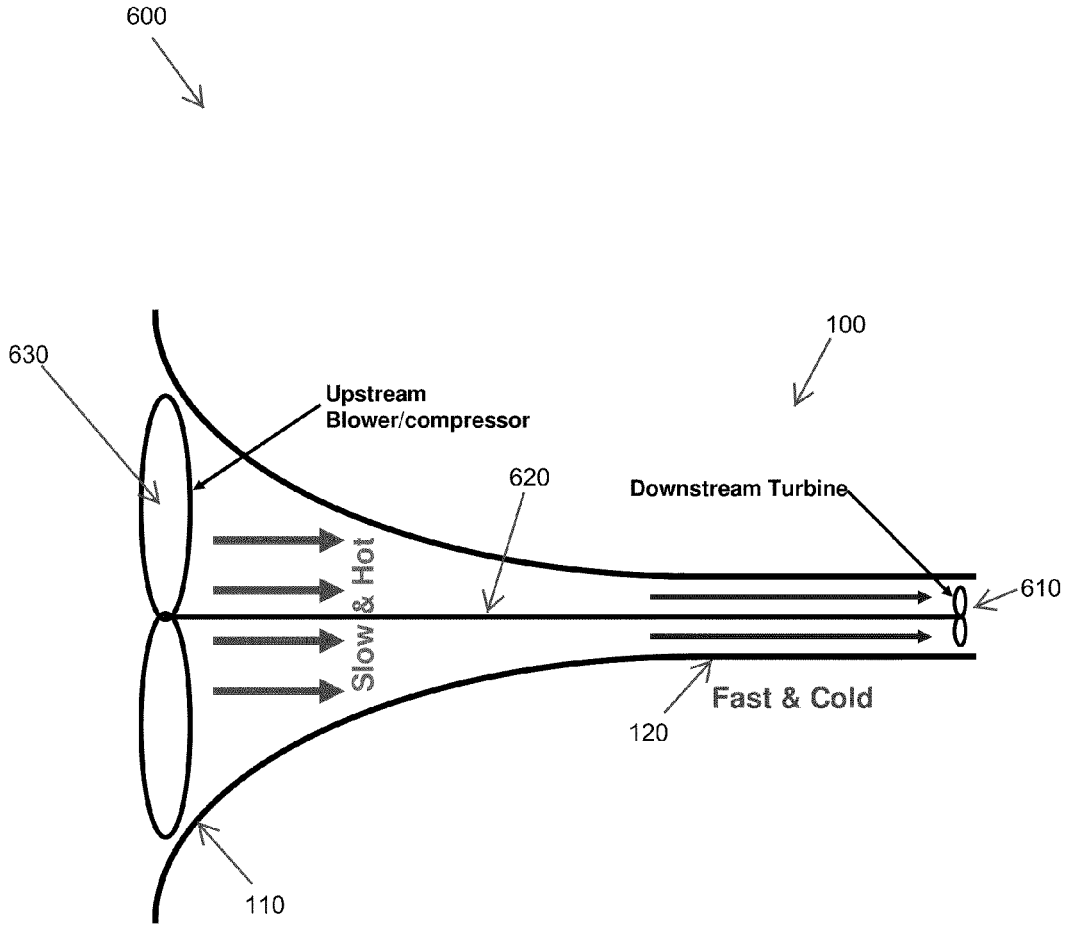
FIG. 6A shows a schematic side view of a heat transfer system including a drive system, in accordance with one embodiment of the invention.
Figure 6B:
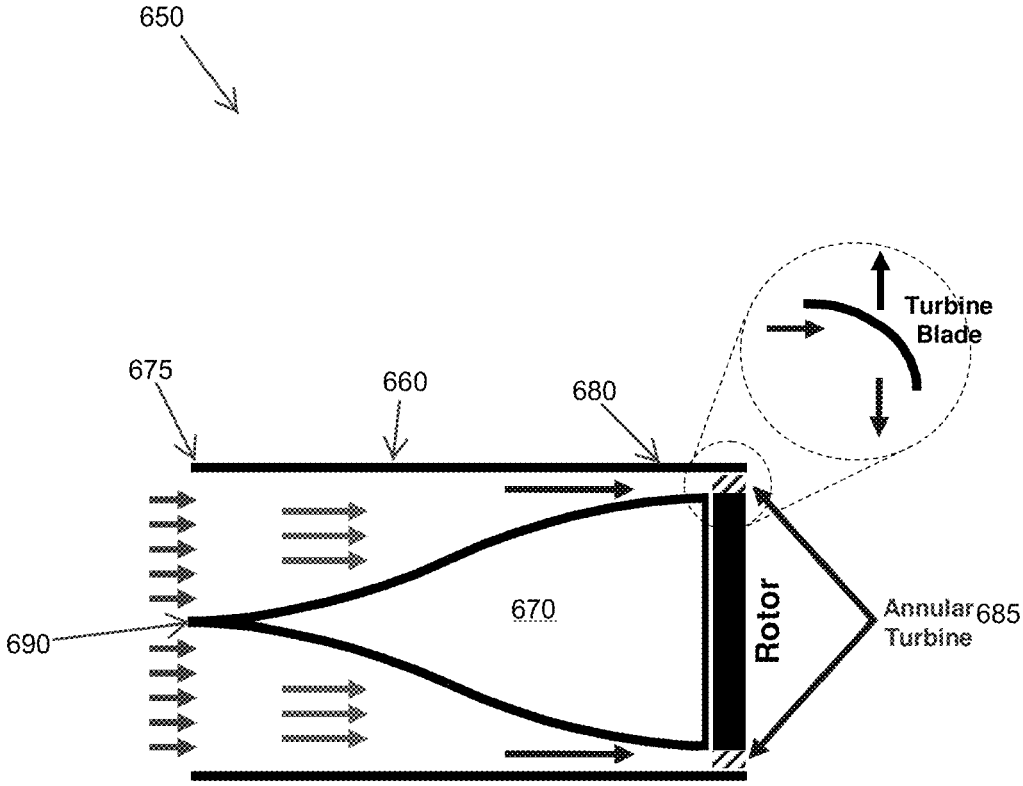
FIG. 6B shows a schematic side view of another heat transfer system including a drive system, in accordance with one embodiment of the invention.

FIG. 6A illustrates an exemplary heat transfer system 600 including a first radial array of blades 610 within a neck portion 120 of a venturi 100. The first radial array of blades 610 is coupled through a mechanical linkage 620 to a second radial array of blades 630 located in an inlet portion 110 of the venturi 100. The mechanical linkage 620 may include a gearing mechanism (not shown). The first radial array of blades 610 and second radial array of blades 630 may be unitary or may include multiple radial arrays of blades. In operation, the working fluid is driven through the venturi 100 by the second radial array of blades 630. As the working fluid accelerates and passes through the neck portion 120, the fluid drives the first radial array of blades 610 located therein. The energy extracted by the first radial array of blades 610 is fed back into the second radial array of blades 630 through the mechanical linkage 620 to provide energy to drive the second radial array of blades 630. Any additional energy required to drive the second radial array of blades 630 may be provided by an electrical motor or other suitable driving mechanism. As discussed hereinabove, a heat source may be located within the neck portion, allowing heat to be transferred from the heat source to the working fluid.

In an alternative embodiment, a heat transfer system 650 includes a cylindrical flow channel 660 with a flow deflector 670 located substantially centrally therein to change the cross-sectional area from an inlet portion 675 to a neck portion 680 of a heat transfer system 650. In this embodiment, a first radial array of blades 685 is housed within a portion of the flow deflector 670 and driven by the working fluid as it flows around the flow deflector 670 and through the reduced cross-sectional area between the wall of the flow deflector 670 and the wall of the cylindrical flow channel 660. The energy extracted by this first radial array of blades 685 is then used to drive at least one second radial array of blades (not shown), as described hereinabove. In one implementation, the second radial array(s) 630 are located at or near a leading edge 690 of the flow deflector 670. In an alternative implementation, the second radial array(s) 630 are located elsewhere within the system, e.g., upstream of the neck portion 680, downstream of the neck portion 680, and/or within a flow return portion of a closed loop system. One or more heat sources may be placed in thermal communication with the cylindrical flow channel 660 and/or the flow deflector 670 within the neck portion 680, allowing heat to be transferred from the heat source to the working fluid within the neck portion 680. A flow diffuser may be positioned downstream of the neck portion 680 to assist in smoothly transitioning the working-fluid flow from a fast and cold state to a slow and hotter state downstream of the neck portion 680. This flow diffuser may, for example, be shaped similarly to, but oriented in an axially opposite direction from, the flow deflector 670.

Figures 7A, 7B, 7C:
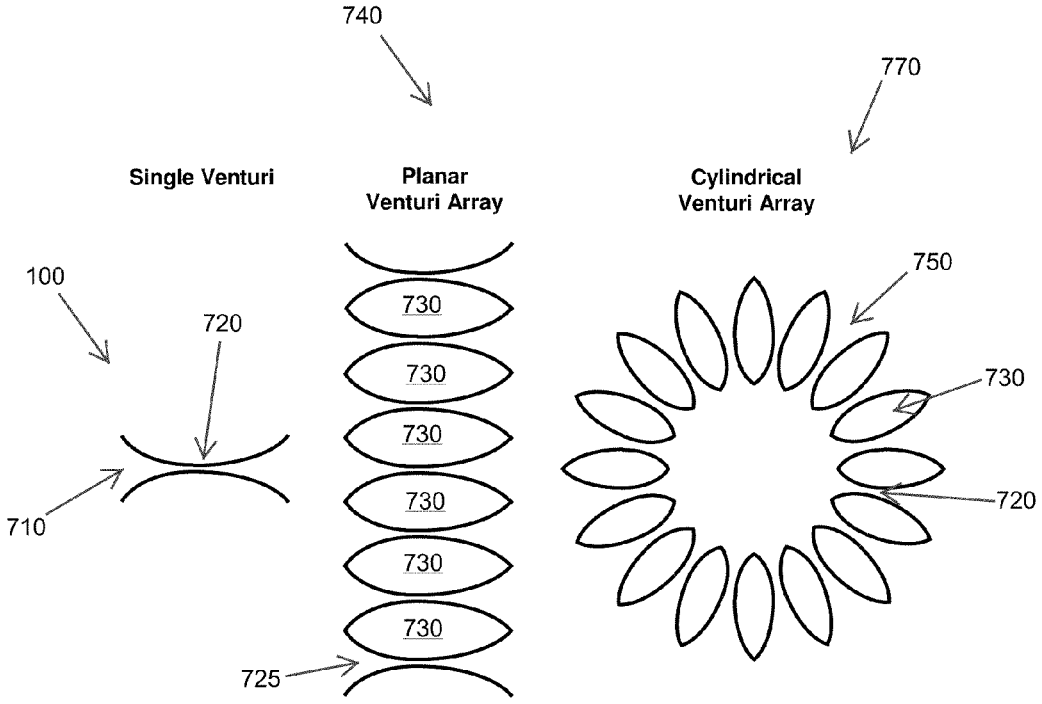
FIG. 7A shows a schematic side view of a single venturi, in accordance with one embodiment of the invention.
FIG. 7B shows a schematic side view of a planar venturi array, in accordance with one embodiment of the invention.
FIG. 7C shows a schematic side view of a cylindrical venturi array, in accordance with one embodiment of the invention.

In various embodiments of the invention, the flow path through a neck portion of a heat transfer system and, for example, a neck portion of a venturi, may be arranged in a number of different configurations. Exemplary configurations are shown in FIG. 7A through 7C. In FIG. 7A, the first flow path 710, i.e., the working-fluid flow path, includes a flow path through a neck portion 720 of a single venturi 100, as described hereinabove. In FIG. 7B, the first flow path 725, includes a flow path through a plurality of neck portions 120 formed by a plurality of blades 730 arranged as a planar venturi array 740.

In FIG. 7C, the first flow path 750 includes a flow path through a plurality of neck portions 120 formed by a plurality of blades 730 arranged radially about a central portion 760 as a cylindrical venturi array 770. In this embodiment, the working fluid is driven into the central portion 760 through an entrance flow path, and the fluid flows radially outward between the blades 730. Locating one or more heat sources at or near the neck portion 720 of the first flow path 750 between the adjacent blades 730 allows heat to be transferred from the heat source to the working fluid, as described hereinabove.

Figures 8A, 8B:
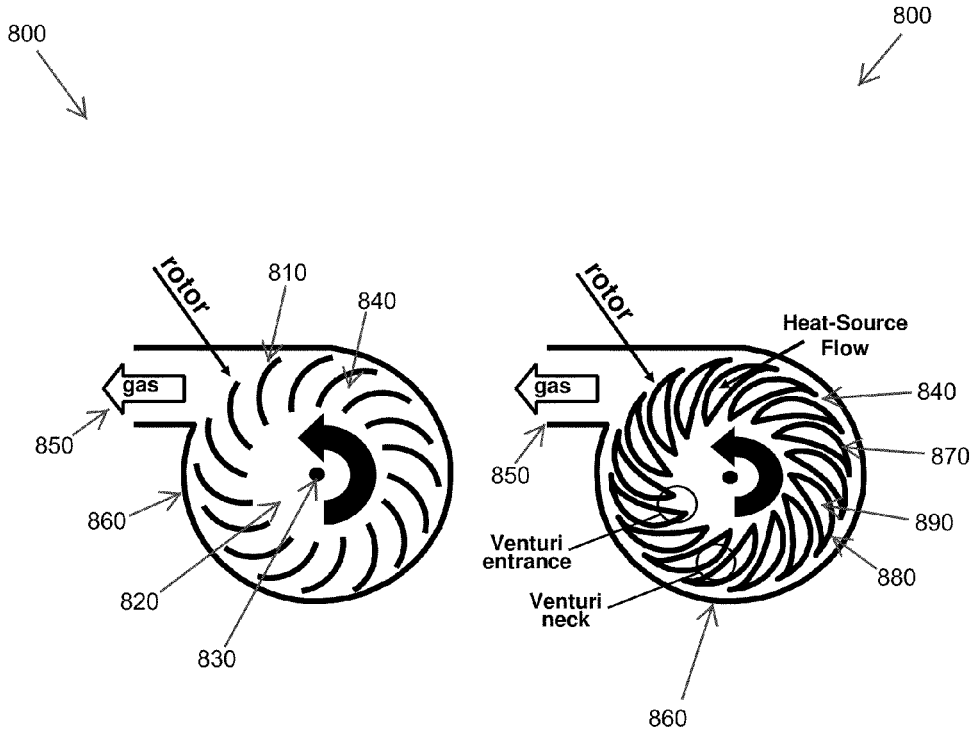
FIG. 8A shows a schematic plan view of a squirrel-cage heat transfer system, in accordance with one embodiment of the invention.
FIG. 8B shows a schematic plan view of another squirrel-cage heat transfer system, in accordance with one embodiment of the invention.

FIG. 8A illustrates exemplary heat transfer systems 800 that include a radial array of blades having a plurality of blades 810 arranged about a central portion 820. The heat transfer system 800 is formed as a squirrel-cage-type system with a working fluid entering the central portion 820 along an entrance flow path substantially along the radial axis 830 of the system 800. The working fluid flows radially out through a first flow path 840 between adjacent blades 810 and exits the squirrel-cage through an exit flow path defined by a channel 850 extending from the casing 860 of the squirrel-cage. In operation, the blades 810 rotate about the central radial axis, thereby drawing the working fluid into the central portion 820 through the entrance flow path and forcing the working fluid through the first flow path 840 between the adjacent blades 810. The working fluid is then forced out through the channel 850 defining the exit flow path. The blades 810 may be driven at any rotational velocity adequate to provide the appropriate flow speed through the first flow path 840 between adjacent blades 810.

Placing a heat source in thermal communication with the blades 810, or at least a portion thereof, causes the first flow path 840 between the adjacent blades 810 to act as a working-fluid flow path for a Bernoulli-type heat transfer system, with heat being transferred from the heat source through the blades 810 and into the fast moving, and therefore cooled, working fluid. The blades may be of any appropriate shape to provide the required fluid flow conditions in the first flow path 840. In the embodiment of FIG. 8A, the blades 810 have a unitary shape and are formed of a solid thermally conductive material such as, but not limited to, copper or aluminum. In other embodiments, the blades may have different shapes.

FIG. 8B illustrates an exemplary cylindrical squirrel-cage-type heat transfer system 800 with hollow blades 870. In this embodiment, each blade 870 includes an outer wall 880 defining a channel 890 through which a second fluid (i.e., a fluid transporting a heated fluid from one or more heat sources) flows. Each blade 870 is shaped such that the first flow path 840 (i.e., the working-fluid flow path) between adjacent blades has a venturi shape. As a result, as the working fluid is driven through the first flow path 840, heat is transferred through the outer walls 880 of the blades 870 from the heat-source fluid flow to the working-fluid flow. As with the other venturis described herein, the outer wall 880, or a portion thereof, may include, or consist essentially of, a material having a high thermal conductivity relative to the surrounding structure. For example, the outer wall 880 may have a high-thermal-conductivity material (e.g., a metal) placed at and/or near the apex of the venturi-shaped first flow path 840, with a lower-thermal-conductivity material making up the remainder of the outer wall 880. As a result, heat transfer between the heat-source flow and the working-fluid flow will take place primarily at the apex of the venturi, where the working fluid is at or near its highest velocity and lowest temperature, thereby maximizing the heat-transfer rate.

The heat transfer system 800 may be a closed loop system or an open loop system. For an open loop system, the working fluid, such as air or water, is drawn into the entrance flow path from the surrounding atmosphere and driven through the first flow path 840 between adjacent blades 810 by the rotation of the blades 810. The working fluid is then vented back out to the surrounding atmosphere through the channel 850 defining the exit flow path. For a closed loop system, the channel 850 defining the exit flow path is coupled to a return flow path that returns the working fluid back to the entrance flow path, as shown, for example, in FIGS. 4A and 4B. The closed-loop system may provide a substantially constant mass flux for the working fluid though the system.

Figure 9:
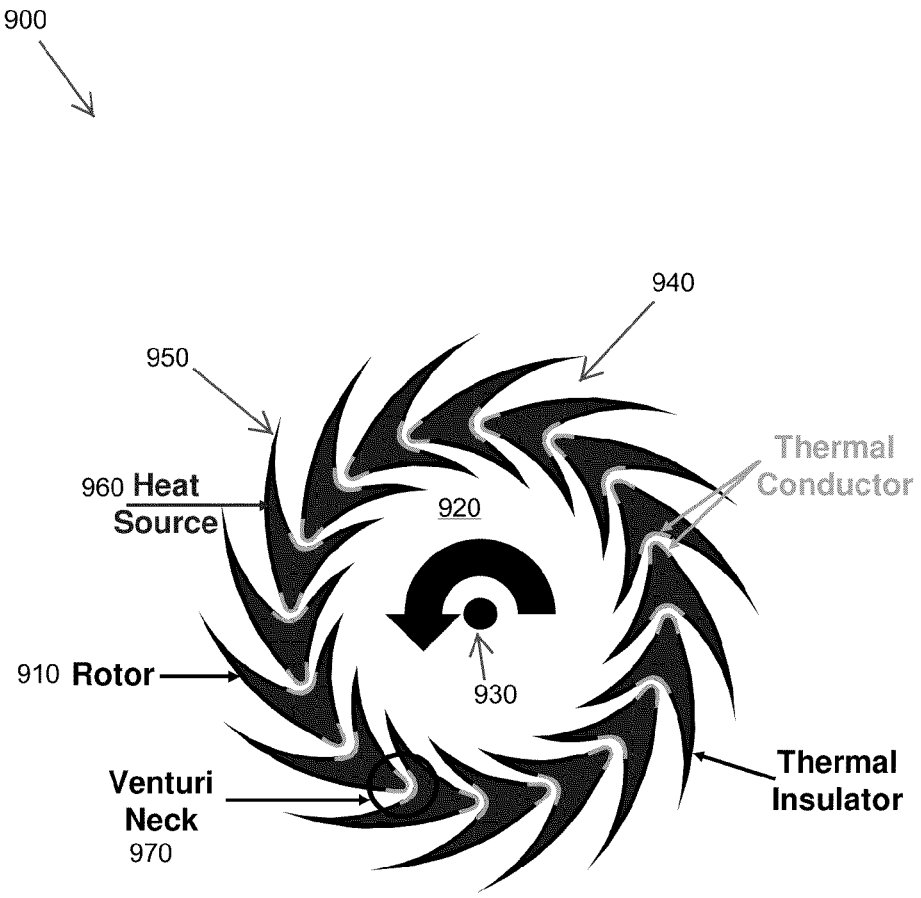
FIG. 9 shows a schematic end view of a cylindrical blade array including a plurality of curved blades, in accordance with one embodiment of the invention.

The number, size, and geometry of the blades may vary depending on the application. The configuration of the blades dictates the shape of the first flow path between adjacent blades. For example, in one embodiment, the first flow path between adjacent blades is substantially straight. In another embodiment, the first flow path between adjacent blades is, at least in part, substantially curved. An exemplary cylindrical blade array 900 for use, for example, in a squirrel-cage-type heat transfer system, is shown in FIG. 9.

In this embodiment, the cylindrical blade array 900 includes a plurality of blades 910 arranged around a central portion 920 and configured to rotate about a central axis 930, with a first flow path 940 defined by the gap between the adjacent blades 910. Each blade 910 includes an outer wall 950 defining a flow channel 960 through which a second fluid (i.e., a fluid transporting a heated fluid from one or more heat sources) flows. The outer wall 950 includes a portion exhibiting a high thermal conductivity, with respect the remainder of the outer wall 950, located at and/or near an apex portion 970. The blades 910 are shaped such that the first flow path 940 follows a curved path, with the apex of the curve at an apex portion (i.e. a portion having a minimum cross-sectional area) of the first flow path 940. In alternative embodiments, differently shaped blade arrays and/or flow paths may be used, as appropriate.

In operation, a heat-source fluid flow is driven through at least one of the blades 910, allowing heat to be transferred from the heat source to the working fluid at the apex portion 970 as the working fluid is driven through the first flow path 940 by the rotation of the blades 910 about the central rotational axis 930. In one embodiment, the flow channels 960 for two or more adjacent blades 910 are connected at a distal end of the blades 910, such that the heat-source flow within the second flow path defined by the channels 960 flows in one direction along the length of one blade 910 before flowing back along the length of an adjacent blade 910 in the opposite direction. As a result, the heat-source flow need only fluidly communicate with the blades 910 at one end of the system 900.

Figure 10:
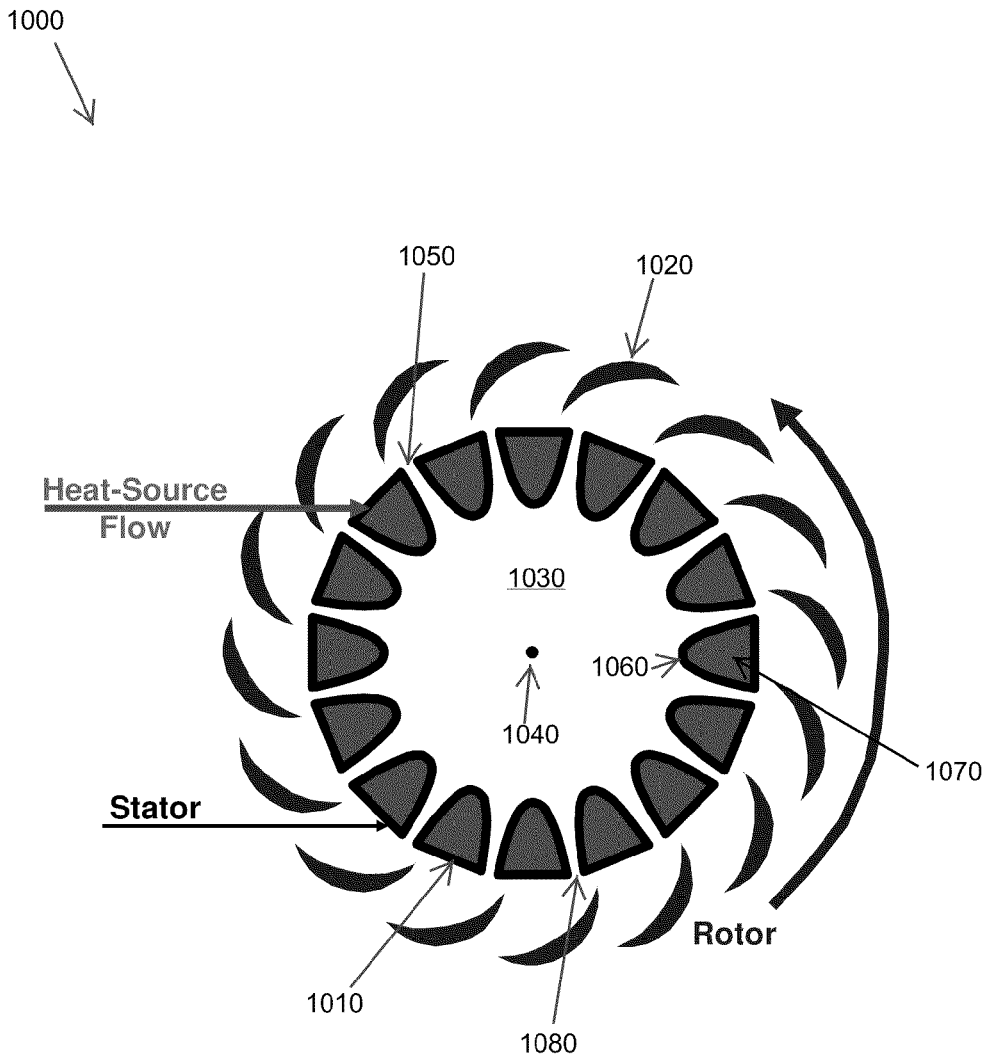
FIG. 10 shows a schematic end view of a cylindrical blade array including a plurality of stators surrounded by a plurality of rotors, in accordance with one embodiment of the invention.

With reference to FIG. 10, a cylindrical blade array 1000 may include a plurality of stator portions 1010 surrounded by a plurality of rotor portions 1020. As before, the plurality of stators 1010 and rotors 1020 are arranged around a central portion 1030 and configured to rotate about a central axis 1040, with a first flow path 1050 defined by the gap between the adjacent stators 1010 and adjacent rotors 1020. Each rotor 1010 includes an outer wall 1060 defining a flow channel 1070 through which a second fluid (i.e., a fluid transporting a heated fluid from one or more heat sources) flows. The outer wall 1060 may include a portion exhibiting a high thermal conductivity with respect the remainder of the outer wall 1060, and located at and/or near an apex portion 1080 of the stators 1010. In operation, the stators 1010 remain stationary while the rotors 1020 rotate around an outer radial wall of the stators 1010. The rotation of the rotors 1020 drives a working fluid through an entrance flow path into the central portion 1030 and out through the first flow path 1050 defined by the gap between the adjacent stators 1010 and adjacent rotors 1020.

Figures 11A, 11B:
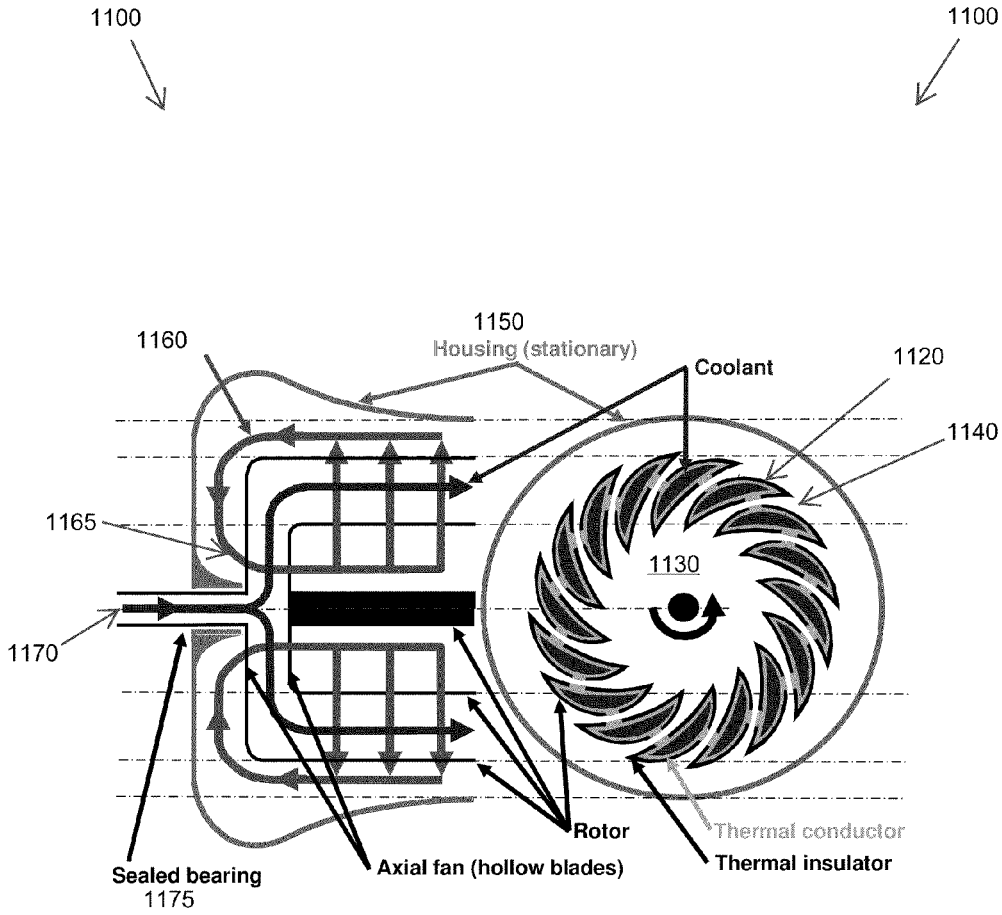
FIG. 11A shows a schematic side view of the flow paths through a cylindrically arranged heat transfer system, in accordance with one embodiment of the invention.
FIG. 11B shows a schematic end view of the heat transfer system of FIG. 11A.

An exemplary heat-transfer-system flow arrangement 1100 through a cylindrically oriented blade array for a squirrel-cage-type heat transfer system is shown in FIGS. 11A and 11B. This flow arrangement 1100 may be utilized with any of the rotor blades and/or stator arrays described herein, or with any other suitably configured blade arrangement. As described hereinabove, a squirrel-cage-type heat transfer system 1110 includes a plurality of hollow blades 1120 configured to rotate about a central portion 1130, with a first flow path 1140 defined between adjacent blades 1120. A housing 1150 is located outside the blade array and guides the working fluid exiting the first flow path 1140 into a return flow path 1160 that returns the working fluid through an entrance flow path 1165 to the central portion 1130. A second fluid flow path 1170 (i.e., a heat-source fluid flow path) extends through a sealed central bearing 1175 and through a plurality of the blades 1120. In one embodiment, two or more adjacent blades 1120 are connected at a distal end thereof, such that the heat-source flow path 1170 flows in one direction along the length of one blade 1120 before flowing back along the length of an adjacent blade 1120 in the opposite direction. As a result, the heat-source flow 1170 need only be fluidly connected to the blades 1120 at one end of the system 1110, with the sealed central bearing 1175 housing both a heat source entrance flow and a heat source exit flow.

The system 1110 operates as a closed-loop heat transfer system, with the working fluid being driven through the first flow path 1140 by the rotation of the blades 1120, and then being returned through a return flow path 1160 and an entrance flow path 1165 to the central portion 1130 to repeat the process. Simultaneously, a fluid flow from a heat source is driven through the second fluid flow path 1170 within the hollow blades 1120 through the sealed bearing 1175. As a result, as the working fluid is driven through the first fluid flow path 1140, heat is transferred through a high-thermal-conductivity portion of the walls of the blades 1120 from the heat-source flow to the working fluid. As described above, one or more heat exchangers may be positioned along the return flow path 1160 to remove the heat added to the working fluid from the heat source.

In one embodiment, the blades 1120 are rotated at a sufficient rotation rate to cause a mean flow direction of the first flow path to point at least partially towards a rear surface of the blades 1120, thereby causing the working-fluid flow to impinge on the rear of each blade 1120 and provide kinetic energy to the blades 1120, increasing the efficiency of the system.

Figures 12A, 12B, 12C:
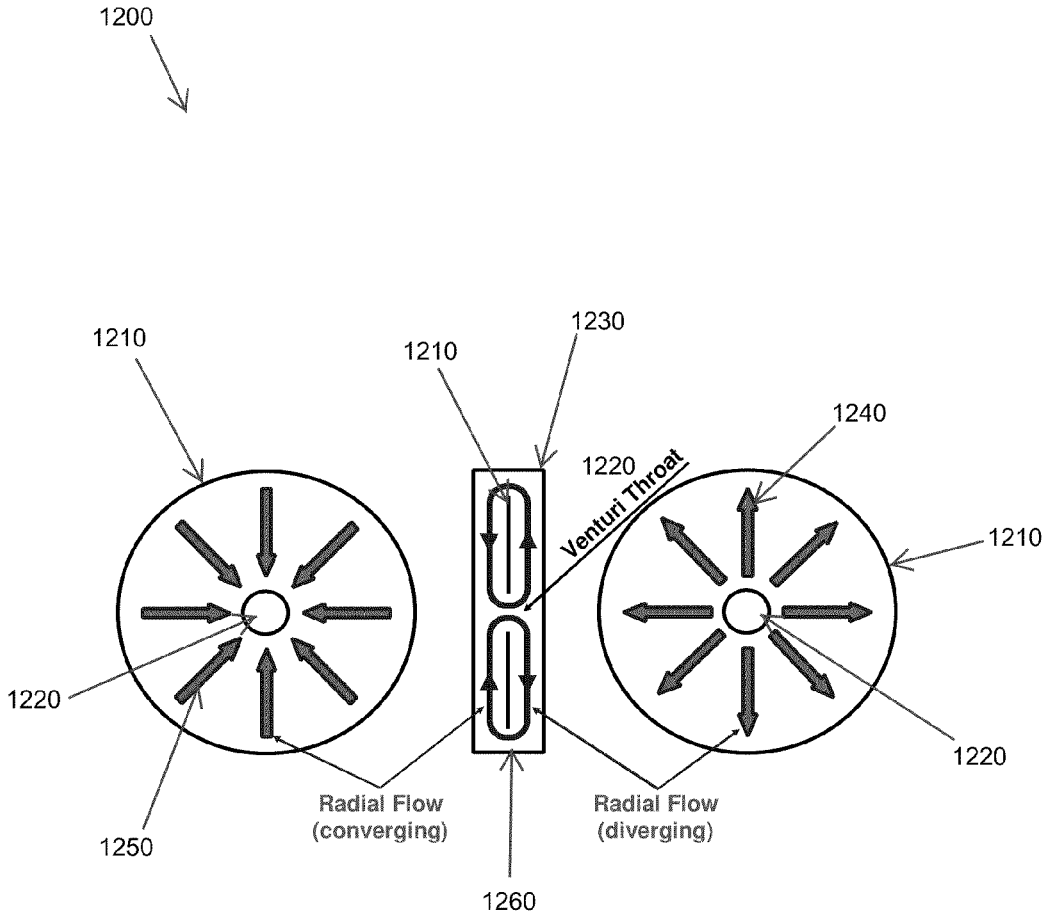
FIG. 12A shows a schematic front view of another cylindrically arranged heat transfer system, in accordance with one embodiment of the invention.
FIG. 12B shows a schematic top plan view of the heat transfer system of FIG. 12A.
FIG. 12C shows a schematic bottom plan view of the heat transfer system of FIG. 12A.

A heat transfer system including a first flow path through a cylindrically arranged blade array may include a wall separating the blade array from the return flow path. For example, FIG. 12 shows a closed-loop heat transfer system 1200 including a wall or plate 1210 with an open central portion 1220. The plate 1210 may be of any suitable cross-sectional thickness and geometry. For example, in one embodiment, the plate 1210 is substantially cylindrical in form and of sufficient thickness to allow one of more flow channels (used to carry a heat source flow through the plate) to be embedded therein. The plate or housing 1210 may be formed as a single structure or may include a plurality of interconnected structures. The plate 1210 can be used to house elements including, but not limited to, one or more heat-source flow channels, one or more heat exchanger elements, one or more measurement devices, one or more control devices, and/or a power source and/or controller for a working fluid and/or heat source fluid drive system. A housing 1230 encloses the system 1200. The plate may include structure or structural elements, such as baffles, walls, and/or strengthening elements, separating the radially diverging and radially converging flows.

The system 1200 includes a radially diverging flow 1240 extending out from the open central portion 1220 on one side of the plate 1210, with a radially converging flow 1250 extending towards the open central portion 1220 on the other side of the plate 1210. In operation, the flow path for a working fluid extends through the open central portion 1220, out along the radially diverging flow path 1240 on one side of the plate 1210, up through an outer flow return path 1260 extending around an outer radial edge of the plate 1210, and back towards the open central portion 1220 along the radially converging flow path 1250. The flow may be driven, for example, by a plurality of rotor blades located within the radially diverging flow path 1240 on one side of the plate 1210 and rotating about the open central portion 1220.

In operation, the working-fluid flow velocity diminishes as the cross-sectional area of the flow increases with radial distance from the open central portion 1220 along the radially diverging flow path 1240 (due to the increase in cross-sectional area of the flow as the radius from the open central portion 1220 increases). The working fluid then flows along the outer radial wall of the plate 1210 along the outer flow return path 1260 before travelling back to the open central portion 1220 along the radially converging return flow path 1250. The working-fluid flow velocity increases, and the temperature drops, as it converges towards the open central portion 1220 (due to the decrease in cross-sectional area of the flow as the radius from the open central portion 1220 decreases). The maximum working-fluid flow velocity, and therefore the minimum working fluid temperature, occurs where the working fluid passes through the open central portion 1220 of the plate 1210 (i.e., where the cross-sectional area that the working fluid must traverse is at a minimum). As a result, the central open portion 1220 of the plate 1210 effectively acts as a neck or venturi. The minimum working-fluid flow velocity, and therefore the maximum working fluid temperature, occurs where the working fluid passes axially along the outer flow return path 1260.

In this embodiment, a heat source may be placed in thermal communication with at least a portion of a boundary wall of the open central portion 1220. As a result, the system 1200 produces a flow equivalent to other venturi-flow heat transfer systems described herein, with a working fluid being accelerated through a first flow path (in this case the open central portion 1220) and with heat being transferred to the working fluid from a heat source in thermal communication with the boundary wall of the first flow path. One or more heat exchangers may be placed at any appropriate location along the return flow path (e.g., within the outer flow return path 1260 and/or the radially converging return flow path 1250) within the closed loop flow to remove heat from the working fluid. In one embodiment, a heat exchanger is located at or near the outer flow return path 1260 (i.e., where the flow passes axially along the outer radial edge of the plate 1210 and transitions from a radially diverging to radially converging flow) where the working fluid flow has its slowest velocity and highest temperature.

In one embodiment, the heat source includes a solid material that conducts heat to the boundary wall of the open central portion 1220. In an alternative embodiment, the heat source includes a heat-source fluid flow in addition to, or in place of, the solid material. The boundary wall of the open central portion 1220, or at least a portion thereof, may include a portion having a higher thermal conductivity than the surrounding wall, thereby encouraging heat transfer only through the portion of the flow where the temperature differential between the working fluid and the heat source is at a maximum.

Figure 13:
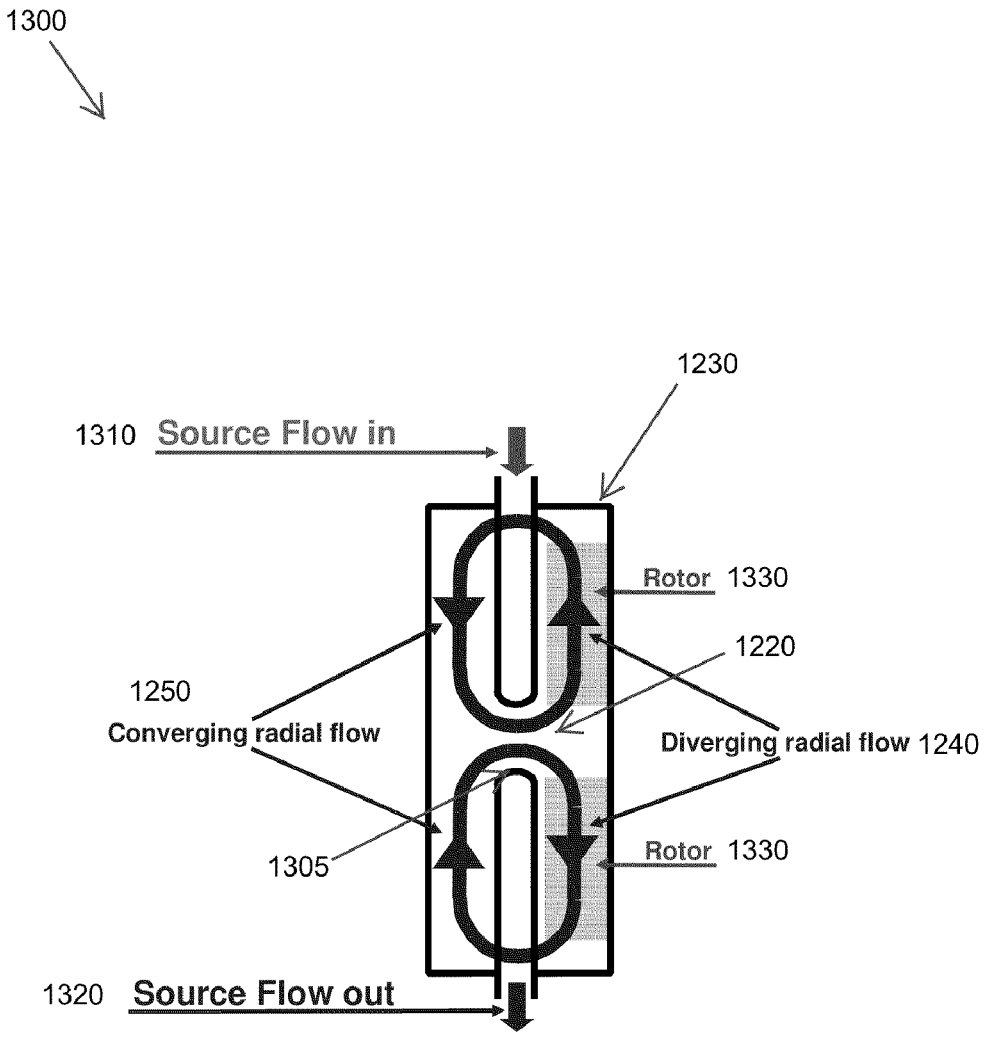
FIG. 13 shows a schematic side view of another cylindrically arranged heat transfer system, in accordance with one embodiment of the invention.

An exemplary heat transfer system 1300 with a heat-source fluid flow carrying heat to the boundary wall 1305 of the open central portion 1220 is shown in FIG. 13. In this embodiment, the heat-source flow enters into a hollow section of the wall 1210 via an entrance portion 1310, and the flow exits via an exit portion 1320 after passing the boundary wall 1305 of the open central portion 1220. The wall 1210 may be entirely hollow, thereby allowing the heat-source flow to flow freely through the entire hollow inner chamber of the wall 1210, or the wall 1210 may instead be substantially solid with flow paths embedded therein to transport the heat-source fluid from the entrance portion 1310, past the boundary wall 1305 of the open central portion 1220, and out through the exit portion 1320. These flow paths may take any form that ensures the heat-source flow is capable of passing heat through the boundary wall 1305 of the open central portion 1220 and into the working fluid. The boundary wall 1305 may be curved or flat. In one embodiment, the boundary wall 1305 of the open central portion 1220 is curved to form a venturi within the open central portion 1220. A rotor blade array 1330 is positioned within the radially diverging flow path 1240 to drive the flow.

Figure 14:
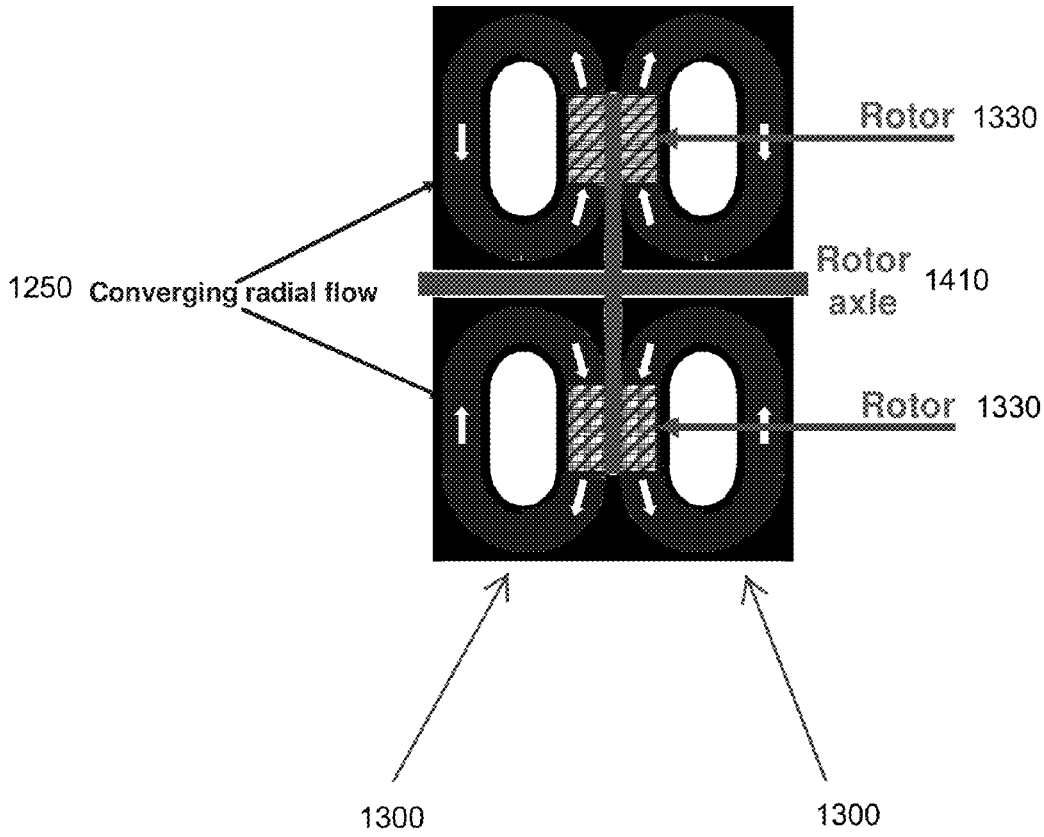
FIG. 14 shows a schematic side view of a stacked cylindrically arranged heat transfer system, in accordance with one embodiment of the invention.

One embodiment of the invention, shown in FIG. 14, includes a plurality of separate closed-loop heat transfer systems 1300 connected together. In this embodiment, a single driving mechanism may be used to drive the flow within a plurality of heat transfer systems 1300, for example, by having a rotor blade array 1330 for each closed-loop system coupled to a single rotor axle 1410. In this embodiment, two closed-loop flows are placed back-to-back. In an alternative embodiment, three or more closed loop flows are placed back-to-back to form an array of heat transfer systems. These heat transfer systems may be in thermal communication with the same and/or different heat sources.

The configuration of FIGS. 12-14 may be used with any of the embodiments described herein, including arrays of rotor blades having heat sources therein, rotor/stator blade arrays, and/or "no-touch" blade arrays. In each of these embodiments, heat may be pumped from a heat source to a working fluid through the open central portion 1220 (i.e. the open flow path through the central portion of the plate 1210) and/or through one or more neck portions defined between adjacent blades. In each of these embodiments, the plate 1210 may be of any arbitrary thickness.

The cylindrical heat transfer systems described herein may transfer heat to a working fluid from a heat source in thermal communication with the boundary wall of the open central portion, from a heat source in thermal communication with one or more of a plurality of rotor blades driving the working-fluid flow, and/or at any other appropriate location around the system. In addition, the cylindrical heat transfer systems may include any of the measurement and/or control systems described herein.

Figure 15:
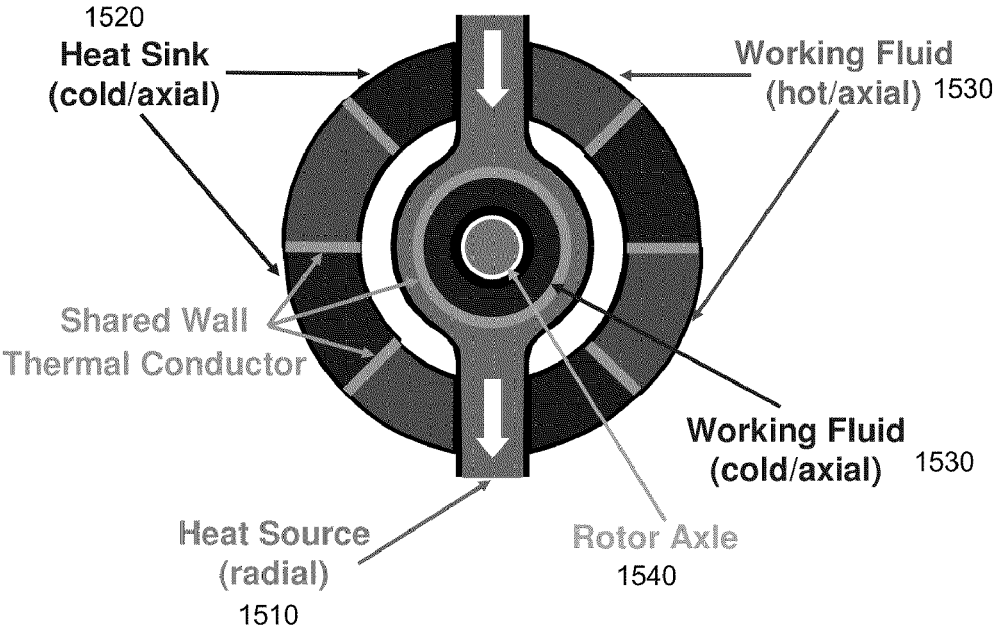
FIG. 15 shows a schematic view of a plurality of flow paths through a cylindrically arranged heat transfer system, in accordance with one embodiment of the invention.

In one embodiment, heat is transferred from the heat-source flow to the cold portion of the working fluid (e.g., the portion of the working fluid traveling through the neck portion of a venturi-shaped first fluid flow path), and from the hot portion of the working fluid (e.g., the slow-moving portion of the working fluid within the return flow path) to a sink flow (e.g., a fluid flow within a heat exchanger located along at least a portion of the return flow path). The system may include multiple working-flow, sink-flow pairs. An exemplary system 1500, including four such working-flow, sink-flow pairs is shown in FIG. 15. This embodiment includes three flows: a heat-source flow 1510, a heat-sink flow 1520 (for example, in a heat exchanger) and a working-fluid flow 1530. As with other cylindrically arranged systems described herein, the system is driven by a blade array that rotates about a central rotor axle 1540.

Figure 16:
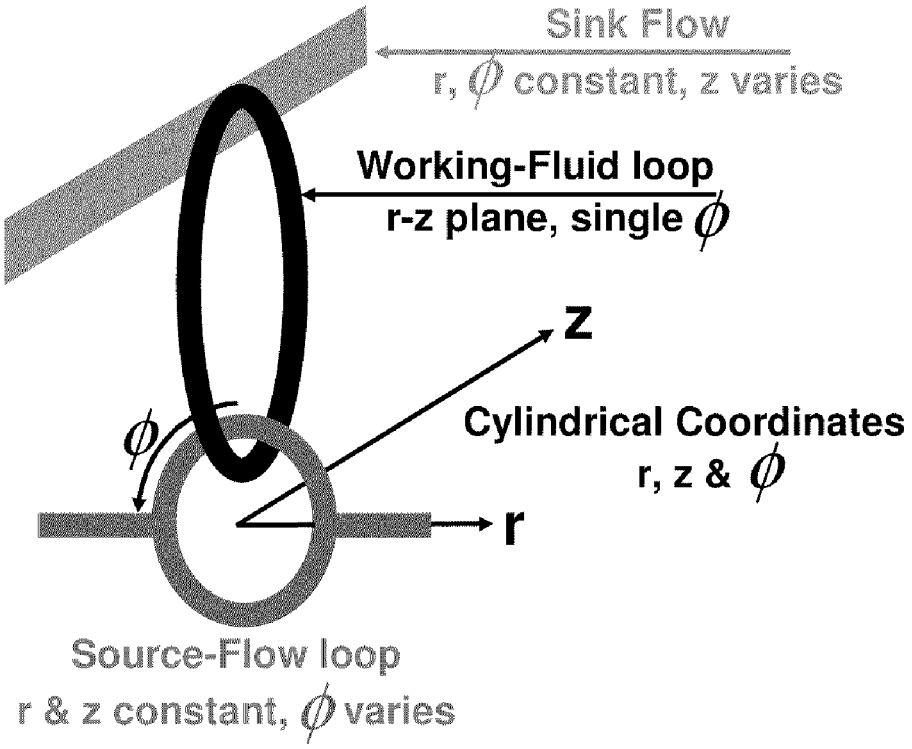
FIG. 16 shows another schematic representation of the fluid flow paths of FIG. 15.

In alternative embodiments, a greater number of working-flow, sink-flow pairs may be utilized. Increasing the number of working-flow, sink-flow pairs may, for example, increase the area of shared wall available for heat transfer, thereby increasing the efficiency of the system. A schematic representation of the relative fluid flow paths is shown in FIG. 16.

Figure 17:
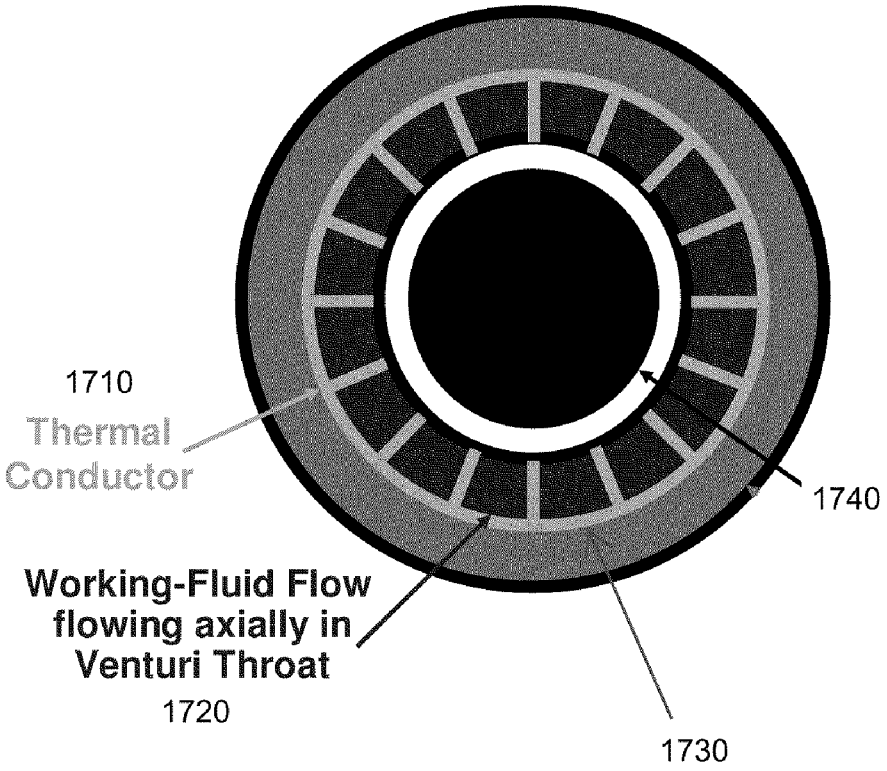
FIG. 17 shows a plan view of a fin arrangement within an open central portion of a cylindrically arranged heat transfer system, in accordance with one embodiment of the invention.

In one embodiment, shown in FIG. 17, one or more fins 1710 are located within the open central portion 1720 of a heat transfer system and extend from the boundary wall 1730 of the open central portion 1720. The system depicted in FIG. 17 has a plurality of fins 1710 or thermal conductors. In this embodiment, the fins 1710 advantageously increase heat transfer between the heat source and the working fluid due to the increase in surface area therebetween. In alternative embodiments, any appropriate number and/or geometry of thermal conductor may be placed within the open central portion 1720. The size, shape, and number of fins 1710 may, for example, be selected to maximize the heat transfer between the heat source (in thermal communication with the fins 1710) and the working fluid while minimizing the effect of the fins 1710 on the working-fluid flow (i.e., minimizing the reduction in fluid flow efficiency due to the addition of the fins 1710). The flow through the open central portion 1720 may also be affected by the size and shape of the rotor axle 1740 extending through the open central portion 1720 to drive the rotor blade array.

Various embodiments of the invention may include cylindrical heat transfer systems wherein rotor blades specifically shaped and driven at a set rotation rate to minimize the interaction between the working-fluid flow between adjacent blades and the walls of the blades themselves. Minimizing the interaction between the blades and the working fluid may be achieved by configuring the system such that the first flow path extends through the space between adjacent blades substantially parallel to the surfaces of those blades, such that the working fluid does not impinge upon (or "touch") the blades as it travels therebetween. Systems that satisfy this "no touch" condition exhibit increased efficiency due to, for example, reduced energy required to drive the system.

In one embodiment, in order to minimize the extent to which the rotor blades "touch" the flow, the shape of each blade is determined by the requirement that the vector addition of the desired radius-dependent radial velocity and the local rotational velocity of the rotor blades is substantially equal to purely radial motion in a stationary coordinate system. In this embodiment, the motion of each point on the rotor blade is purely rotational, dictated by the rotation rate and the local radius.

The radial variation in the local speed of the working-fluid flow may be utilized to improve the efficiency of the system. For example, in one embodiment, a "no touch" flow condition is generated by ensuring that the decline of the local flow speed is directly related to the inverse of the radius. This is simply the conservation of the mass flux through a cross-sectional area that increases linearly with increasing radius, ignoring the fact that the density of the gas may vary with the speed of the flow. In more complex flow models, the effects of density variation as the flow speed decreases may be accounted for. In a further embodiment, a one-dimensional compressible flow model of the flow through a blade array allows for the inclusion of shaftwork, i.e., the energy added to or removed from the flow by turbines or blowers through interaction of the blades with the working fluid. Because, in certain embodiments, viscous losses are unavoidable, and because the no-touch rotor acts as either a blower or turbine when rotated at rates other than its design rotation rate, the no-touch rotor also provides the required driving force. In certain embodiments, the effects of viscous losses may be accounted for either phenomenologically with a quasi-one-dimensional model or multidimensional (computational fluid dynamics) analysis, or empirically using experimental data.

In one embodiment, the shape of each blade in a blade array is determined based on two parameters: (i) a function $v(r)$ describing the velocity of the working fluid flow as a function of radius, if the flow were perfectly radial (that is, no rotational motion), and (i) a design rotation speed. In one embodiment, the function $v(r)$ may be determined by a relationship $v(r) \sim 1/r$. In an alternative embodiment, the function $v(r)$ may depend on additional factors to account, for example, for compressible flow. In one embodiment, the function $v(r)$ may be simply proportional to $1/r$. Such a choice reflects the conservation of mass in a constant-density flow through a cross-sectional surface area that is increasing as a function of radius. In an alternative embodiment, different functions for $v(r)$ may be utilized. These functions may address factors such as, but are not limited to, compressible flow, compressible flow with viscous losses, and/or empirical data from experimental results. For example, in one embodiment the function $v(r)$ can be varied until the design rotation rate and measured "diffuser rotation rate" become substantially equal.

In one embodiment, at a specific rotation rate the no-touch rotor neither substantially consumes nor substantially produces work/power and, as such, acts simply as a diffuser. In one embodiment, the blade array will produce some entropy that in turn produces a pressure drop across the diffuser. That pressure drop may be restored, for example, by rotating the blade array slightly faster than its diffuser, or no-touch, rate, to compensate for any entropy in the system, thereby making it serve as an integrated diffuser and blower. In one embodiment, the blade array is rotated at its diffuser or no-touch rate, with another blade array such as, but not limited to, an axial blower located within an outer flow return path, providing a driving mechanism for the flow, for example to compensate for entropy.

Figure 18:
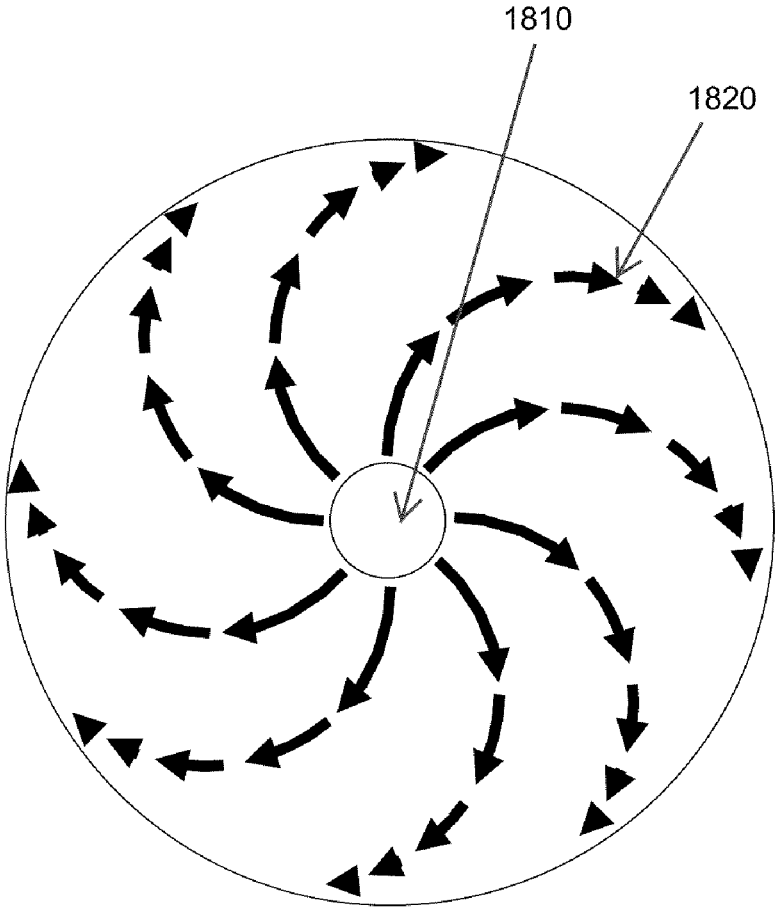
FIG. 18 shows a plan view of a first fluid flow path for a "no-touch" condition flow through a cylindrically arranged blade array, in accordance with one embodiment of the invention.
Figure 19:
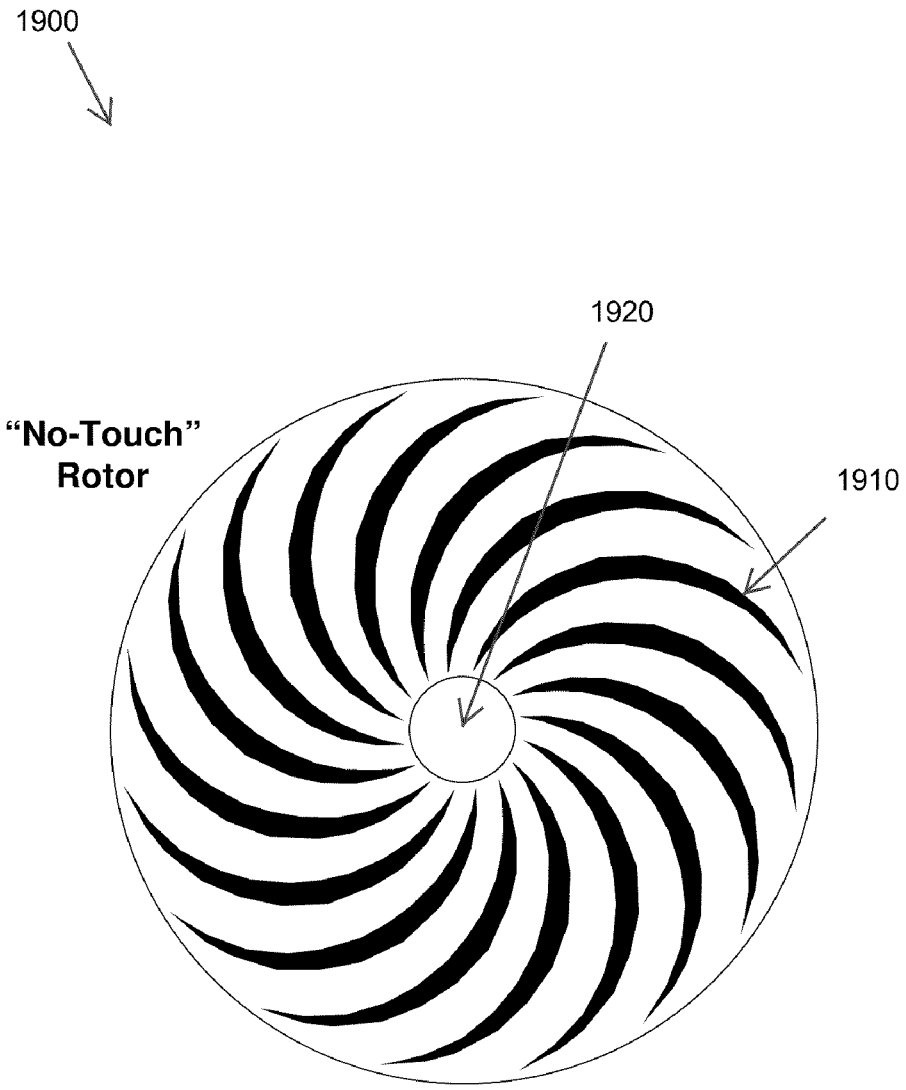
FIG. 19 shows a plan view of a cylindrically arranged blade array for use in a "no-touch" condition flow, in accordance with one embodiment of the invention.

The effect of turbulence within the system may be reduced through the use of a "no-touch" condition by, for example, minimizing the interaction within a boundary layer on the surface of the blades due to impingement of the working fluid on the blades. This may be achieved, for example, through blade shaping and/or rotational speed selection such that the mean flow path of the working-fluid flow through the blades matches the shape of the blades themselves, thereby minimizing the interaction between the working-fluid flow and the blade walls as the working-fluid flows radially out through the blade array. FIG. 18 illustrates an exemplary working-fluid flow-path pattern flowing out from an open central portion 1810 through a blade array (not shown) in a rotational frame. In this embodiment, to provide for a substantially "no-touch" fluid flow, the blades in the rotor blade array conform to the shape of the working-fluid flow paths 1820. An exemplary blade array 1900, including a plurality of shaped blades 1910 located around an open central portion 1920, is shown in FIG. 19. In this embodiment, the blades drive the fluid flow (at least to the extent that rotating the rotor faster than a zero-torque value compensates for pressure loss due to viscous friction in the rotor) while minimizing the interaction between the fluid and the blade walls. One or more of the blades 1910 may also be in thermal communication with one or more heat source, thereby allowing heat to be transferred from the heat source to the working fluid through the wall of the blades 1910 as the working fluid is driven through the blade array. Through appropriate blade shaping and/or rotational speed selection, the "no-touch" flow condition may be utilized with any of the cylindrical heat transfer systems described herein.

The radial array of blades may be rotated clockwise or counterclockwise, depending on the orientation of the blades. In the embodiment of FIG. 19, the blades are oriented such that a counterclockwise rotation of the blade array will produce the required radially diverging working fluid flow therethrough.

In one embodiment, to the extent that the working-fluid flows radially at a speed necessary to ensure the "no-touch" condition, the flow is parallel to the blades. If the local speed in a region within the flow is slower than desired, the advancing face of the rotor blade catches up with it, and imparts energy by pumping or blowing action. If, on the other hand, a portion of the flow moves faster than desired, it encounters the receding (suction) side of the rotor blade and pushes the receding blade, slowing the flow and providing turbine action. For a given rotation rate, the relative amounts of blower and turbine action within the blades determine whether the rotor array is behaving as a net turbine or as a net blower. At one particular rotation rate the two effects cancel, providing a substantially "no touch" flow through the rotor blade array. As a result, the blades may correct for any local non-uniformities within the first fluid flow path of the working fluid by providing a force to the working fluid to minimize deviations from the "no touch" condition.

In operation, the fluid drive system (e.g., the rotating radial array of blades that interact with the working fluid flow) may act as a blower, a turbine, and/or a pure diffuser (for the "no-touch" flow). For a fluid drive system acting primarily as a blower, the advancing surface of each blade pushes on the working fluid flow as it passes through the flow path between the adjacent blades to drive the fluid through the system. For a fluid drive system acting primarily as a turbine, the working fluid flow pushes on the receding surface of the blades of the blade array, thereby driving the rotation of the blades. The net action of the fluid drive system is the combined effect of both the locally acting blower and turbine action over the full blade array. If the rotation rate is below a certain value, the net effect of the rotation of the blade array is to act as a turbine. If the rotation rate is above a certain value, the net effect of the rotation of the blade array is to act as a blower. By appropriate selection of the rotation rate, blade geometry, and/or working fluid, the net effect of the rotation of the blade array may provide a diffuser action with no net blower or turbine action on the working fluid (i.e., the "no-touch" condition).

Because of viscous losses associated with the no-slip boundary condition at the surfaces of the rotor blades, the pressure of the working fluid as it exits the first fluid flow path rotating at a turbine rate is not sufficient to maintain the closed-loop flow throughout the entire system. In such circumstances, to provide the pressure required to sustain the flow, the rotor blade array rotates at a blower rotation rate. As a result, the no-touch configuration for the rotor blade array is efficient as, for example, the stagnation-pressure drop across the rotor is significantly smaller than that found with traditional diffusers. The power required to provide the required blower action is less than required by a traditional blower operating on slowly moving input gas. Thus, less pressure increase is required and it is cheaper (in power) to provide what is required.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A system for transferring heat, comprising:

a first flow path through at least one neck portion defined by at least one boundary wall;

a first heat source external to and in thermal communication with the at least one boundary wall;

an inflow portion in fluid communication with the first flow path;

an outflow portion in fluid communication with the first flow path; and a drive system for driving a first fluid through the first flow path, whereby heat is transferred from the first heat source to the first fluid as it flows through the first flow path, wherein the drive system comprises:

at least one first radial array of blades positioned within the neck portion;

at least one second radial array of blades axially displaced from the neck portion; and a gear box linking the first radial array of blades to the second radial array of blades, wherein a rotation of the first radial array of blades provides a driving force for the second radial array of blades.

2. The system of claim 1, further comprising a radial array of blades comprising a plurality of blades arranged about a central portion defining an entrance flow path, adjacent blades defining the first flow path therebetween.

3. The system of claim 2, wherein the inflow portion is in fluid connection with the central portion of the radial array of blades.

4. The system of claim 2, wherein the outflow portion is located radially outside the plurality of blades.

5. The system of claim 2, wherein the drive system forces the first fluid into the central portion and out through the first flow path between each adjacent blade.

* * * * *